US007967425B2

(12) United States Patent
Dyer et al.

(10) Patent No.: US 7,967,425 B2
(45) **Date of Patent: *Jun. 28, 2011**

(54) PRINTHEAD ASSEMBLY WITH INK SUPPLY SHUT OFF

(75) Inventors: Geoffrey Philip Dyer, Balmain (AU); Gregory Michael Tow, Balmain (AU); David William Jensen, Balmain (AU); Nicholas Kenneth Abraham, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/697,266

(22) Filed: Jan. 31, 2010

(65) Prior Publication Data

US 2010/0134573 A1 Jun. 3, 2010

Related U.S. Application Data

(63) Continuation of application No. 11/677,051, filed on Feb. 21, 2007, now Pat. No. 7,658,482.

(30) Foreign Application Priority Data

Mar. 3, 2006 (AU) ..... 2006901084
Mar. 7, 2006 (AU) ..... 2006901287
Mar. 15, 2006 (AU) ..... 2006201083

(51) Int. Cl.
*B41J 2/14* (2006.01)
*B41J 2/16* (2006.01)

(52) U.S. Cl. ..... 347/85; 347/49; 347/86

(58) Field of Classification Search ..... 347/20, 347/49, 54, 56, 61–65, 67, 84–87
See application file for complete search history.

(56) References Cited

U.S. PATENT DOCUMENTS

| | | | | |
|---|---|---|---|---|
| 4,422,080 | A | 12/1983 | Titcomb | |
| 5,585,826 | A | 12/1996 | Schroeder et al. | |
| 6,116,726 | A | 9/2000 | Driggers | |
| 6,554,412 | B1 | 4/2003 | Seino et al. | |
| 7,097,274 | B2 | 8/2006 | Mantooth et al. | |
| 7,163,282 | B2 | 1/2007 | Kumagai et al. | |
| 7,357,478 | B2 | 4/2008 | Usuda et al. | |
| 7,658,482 | B2 * | 2/2010 | Dyer et al. | 347/85 |
| 2004/0070651 | A1 | 4/2004 | Usui et al. | |
| 2005/0225590 | A1 | 10/2005 | Silverbrook | |
| 2006/0066697 | A1 | 3/2006 | Inoue | |

FOREIGN PATENT DOCUMENTS

| | | | |
|---|---|---|---|
| EP | 0968829 | A | 1/2000 |
| EP | 1552937 | A2 | 7/2005 |
| EP | 1591254 | A2 | 11/2005 |
| WO | WO 2006/030235 | A2 | 3/2006 |

* cited by examiner

*Primary Examiner* — Juanita D Stephens

(57) ABSTRACT

A printhead assembly with a printhead and a shut off (138) valve that has a valve body (200) defining an ink inlet (202) for connection to an ink supply, an ink outlet (67) connected to the printhead IC. A diaphragm (212) is biased into sealing engagement with the valve seat (216) to provide a fluid seal between the ink inlet and the ink outlet. An actuator (204) unseals the diaphragm from the valve seat when energized. The valve protects the ink in the ink supply from contaminants that can migrate up the ink line during shut down periods. The diaphragm is biased to a closed position and so seals the ink supply from the printhead as a default condition even in the event of a power failure. The bias is strong enough to provide the fluid seal so that the seal is not compromised when the pressure difference between the inlet and the outlet is small.

10 Claims, 20 Drawing Sheets

PRINTHEAD ASSEMBLY WITH INK SUPPLY SHUT OFF

CROSS REFERENCE TO RELATED APPLICATIONS

This application is a continuation of U.S. application Ser. No. 11/677,051 filed Feb. 21, 2007, now issued U.S. Pat. No. 7,658,482, all of which is herein incorporated by reference.

FIELD OF THE INVENTION

The present invention relates to the field of printing and in particular inkjet printing.

COPENDING

The following applications have been filed by the Applicant :

| | |
|---|---|
| 7,771,029 | 11/677,050 |

The disclosures of these co-pending applications are incorporated herein by reference.

CROSS REFERENCES

The following patents or patent applications filed by the applicant or assignee of the present invention are hereby incorporated by cross-reference.

| | | | | |
|---|---|---|---|---|
| 6,405,055 | 6,628,430 | 7,136,186 | 7,286,260 | 7,145,689 |
| 7,130,075 | 7,081,974 | 7,177,055 | 7,209,257 | 7,161,715 |
| 7,154,632 | 7,158,258 | 7,148,993 | 7,075,684 | 7,564,580 |
| 7,241,005 | 7,108,437 | 6,915,140 | 6,999,206 | 7,136,198 |
| 7,092,130 | 6,750,901 | 6,476,863 | 6,788,336 | 7,249,108 |
| 6,566,858 | 6,331,946 | 6,246,970 | 6,442,525 | 7,346,586 |
| 7,685,423 | 6,374,354 | 7,246,098 | 6,816,968 | 6,757,832 |
| 6,334,190 | 6,745,331 | 7,249,109 | 7,197,642 | 7,093,139 |
| 7,509,292 | 7,685,424 | 7,743,262 | 7,210,038 | 7,401,223 |
| 7,702,926 | 7,716,098 | 7,170,652 | 6,967,750 | 6,995,876 |
| 7,099,051 | 7,453,586 | 7,193,734 | 7,773,245 | 7,468,810 |
| 7,095,533 | 6,914,686 | 7,161,709 | 7,099,033 | 7,364,256 |
| 7,258,417 | 7,293,853 | 7,328,968 | 7,270,395 | 7,461,916 |
| 7,510,264 | 7,334,864 | 7,255,419 | 7,284,819 | 7,229,148 |
| 7,258,416 | 7,273,263 | 7,270,393 | 6,984,017 | 7,347,526 |
| 7,357,477 | 7,465,015 | 7,364,255 | 7,357,476 | 7,758,148 |
| 7,284,820 | 7,341,328 | 7,246,875 | 7,322,669 | 7,445,311 |
| 7,452,052 | 7,455,383 | 7,448,724 | 7,441,864 | 7,637,588 |
| 7,648,222 | 7,669,958 | 7,607,755 | 7,699,433 | 7,658,463 |
| 11/518,238 | 11/518,280 | 7,663,784 | 11/518,242 | 7,506,958 |
| 7,472,981 | 7,448,722 | 7,575,297 | 7,438,381 | 7,441,863 |
| 7,438,382 | 7,425,051 | 7,399,057 | 7,695,097 | 7,686,419 |
| 7,753,472 | 7,448,720 | 7,448,723 | 7,445,310 | 7,399,054 |
| 7,425,049 | 7,367,648 | 7,370,936 | 7,401,886 | 7,506,952 |
| 7,401,887 | 7,384,119 | 7,401,888 | 7,387,358 | 7,413,281 |
| 7,530,663 | 7,467,846 | 7,669,957 | 7,771,028 | 7,758,174 |
| 7,695,123 | 7,798,600 | 7,604,334 | 7,857,435 | 7,708,375 |
| 7,695,093 | 7,695,098 | 7,722,156 | 7,703,882 | 7,510,261 |
| 7,722,153 | 7,581,812 | 7,641,304 | 7,753,470 | 6,227,652 |
| 6,213,588 | 6,213,589 | 6,231,163 | 6,247,795 | 6,394,581 |
| 6,244,691 | 6,257,704 | 6,416,168 | 6,220,694 | 6,257,705 |
| 6,247,794 | 6,234,610 | 6,247,793 | 6,264,306 | 6,241,342 |
| 6,247,792 | 6,264,307 | 6,254,220 | 6,234,611 | 6,302,528 |
| 6,283,582 | 6,239,821 | 6,338,547 | 6,247,796 | 6,557,977 |
| 6,390,603 | 6,362,843 | 6,293,653 | 6,312,107 | 6,227,653 |
| 6,234,609 | 6,238,040 | 6,188,415 | 6,227,654 | 6,209,989 |
| 6,247,791 | 6,336,710 | 6,217,153 | 6,416,167 | 6,243,113 |
| 6,283,581 | 6,247,790 | 6,260,953 | 6,267,469 | 6,588,882 |
| 6,742,873 | 6,918,655 | 6,547,371 | 6,938,989 | 6,598,964 |

-continued

| | | | | |
|---|---|---|---|---|
| 6,923,526 | 6,273,544 | 6,309,048 | 6,420,196 | 6,443,558 |
| 6,439,689 | 6,378,989 | 6,848,181 | 6,634,735 | 6,299,289 |
| 6,299,290 | 6,425,654 | 6,902,255 | 6,623,101 | 6,406,129 |
| 6,505,916 | 6,457,809 | 6,550,895 | 6,457,812 | 7,152,962 |
| 6,428,133 | 7,216,956 | 7,080,895 | 7,442,317 | 7,182,437 |
| 7,357,485 | 7,387,368 | 11/607,976 | 7,618,124 | 7,654,641 |
| 7,794,056 | 7,611,225 | 7,794,055 | 7,416,280 | 7,252,366 |
| 7,488,051 | 7,360,865 | 7,733,535 | 11/563,684 | 11/482,967 |
| 11/482,966 | 11/482,988 | 7,681,000 | 7,438,371 | 7,465,017 |
| 7,441,862 | 7,654,636 | 7,458,659 | 7,455,376 | 11/124,196 |
| 7,841,713 | 7,877,111 | 7,874,659 | 7,735,993 | 11/124,198 |
| 7,284,921 | 11/124,151 | 7,407,257 | 7,470,019 | 7,645,022 |
| 7,392,950 | 7,843,484 | 7,360,880 | 7,517,046 | 7,236,271 |
| 11/124,174 | 7,753,517 | 7,824,031 | 7,465,047 | 7,607,774 |
| 11/124,172 | 7,566,182 | 11/124,182 | 7,715,036 | 11/124,181 |
| 7,697,159 | 7,595,904 | 7,726,764 | 7,770,995 | 7,370,932 |
| 7,404,616 | 11/124,187 | 7740347 | 7,500,268 | 7,558,962 |
| 7,447,908 | 7,792,298 | 7,661,813 | 7,456,994 | 7,431,449 |
| 7,466,444 | 11/124,179 | 7,680,512 | 11/187,976 | 7,562,973 |
| 7,530,446 | 7,761,090 | 11/228,500 | 7,668,540 | 7,738,862 |
| 7,805,162 | 11/228,531 | 11/228,504 | 7,738,919 | 11/228,507 |
| 7,708,203 | 11/228,505 | 7,641,115 | 7,697,714 | 7,654,444 |
| 7,831,244 | 7,499,765 | 11/228,518 | 7,756,526 | 7,844,257 |
| 7,558,563 | 11/228,506 | 7,856,225 | 11/228,526 | 7,747,280 |
| 7,742,755 | 7,738,674 | 7,864,360 | 7,506,802 | 7,724,399 |
| 11/228,527 | 7,403,797 | 11/228,520 | 7,646,503 | 7,843,595 |
| 7,672,664 | 11/228,515 | 7,783,323 | 7,843,596 | 7,778,666 |
| 11/228,509 | 11/228,492 | 7,558,599 | 7,855,805 | 11/228,514 |
| 11/228,494 | 7,438,215 | 7,689,249 | 7,621,442 | 7,575,172 |
| 7,357,311 | 7,380,709 | 7,428,986 | 7,403,796 | 7,407,092 |
| 7,848,777 | 7,637,424 | 7,469,829 | 7,774,025 | 7,558,597 |
| 7,558,598 | 6,238,115 | 6,386,535 | 6,398,344 | 6,612,240 |
| 6,752,549 | 6,805,049 | 6,971,313 | 6,899,480 | 6,860,664 |
| 6,925,935 | 6,966,636 | 7,024,995 | 7,284,852 | 6,926,455 |
| 7,056,038 | 6,869,172 | 7,021,843 | 6,988,845 | 6,964,533 |
| 6,981,809 | 7,284,822 | 7,258,067 | 7,322,757 | 7,222,941 |
| 7,284,925 | 7,278,795 | 7,249,904 | 7,152,972 | 7,513,615 |
| 6,746,105 | 7,744,195 | 7,645,026 | 7,322,681 | 7,708,387 |
| 7,753,496 | 7,712,884 | 7,510,267 | 7,465,041 | 7,857,428 |
| 7,465,032 | 7,401,890 | 7,401,910 | 7,470,010 | 7,735,971 |
| 7,431,432 | 7,465,037 | 7,445,317 | 7,549,735 | 7,597,425 |
| 7,661,800 | 7,712,869 | 7,156,508 | 7,159,972 | 7,083,271 |
| 7,165,834 | 7,080,894 | 7,201,469 | 7,090,336 | 7,156,489 |
| 7,413,283 | 7,438,385 | 7,083,257 | 7,258,422 | 7,255,423 |
| 7,219,980 | 7,591,533 | 7,416,274 | 7,367,649 | 7,118,192 |
| 7,618,121 | 7,322,672 | 7,077,505 | 7,198,354 | 7,077,504 |
| 7,614,724 | 7,198,355 | 7,401,894 | 7,322,676 | 7,152,959 |
| 7,213,906 | 7,178,901 | 7,222,938 | 7,108,353 | 7,104,629 |
| 7,455,392 | 7,370,939 | 7,429,095 | 7,404,621 | 7,261,401 |
| 7,461,919 | 7,438,388 | 7,328,972 | 7,322,673 | 7,306,324 |
| 7,306,325 | 7,524,021 | 7,399,071 | 7,556,360 | 7,303,261 |
| 7,568,786 | 7,303,930 | 7,401,405 | 7,464,466 | 7,464,465 |
| 7,246,886 | 7,128,400 | 7,108,355 | 6,991,322 | 7,287,836 |
| 7,118,197 | 7,575,298 | 7,364,269 | 7,077,493 | 6,962,402 |
| 7,686,429 | 7,147,308 | 7,524,034 | 7,118,198 | 7,168,790 |
| 7,172,270 | 7,229,155 | 6,830,318 | 7,195,342 | 7,175,261 |
| 7,465,035 | 7,108,356 | 7,118,202 | 7,510,269 | 7,134,744 |
| 7,510,270 | 7,134,743 | 7,182,439 | 7,210,768 | 7,465,036 |
| 7,134,745 | 7,156,484 | 7,118,201 | 7,111,926 | 7,431,433 |
| 7,018,021 | 7,401,901 | 7,468,139 | 7,128,402 | 7,387,369 |
| 7,484,832 | 7,802,871 | 7,506,968 | 7,284,839 | 7,246,885 |
| 7,229,156 | 7,533,970 | 7,467,855 | 7,293,858 | 7,520,594 |
| 7,588,321 | 7,258,427 | 7,556,350 | 7,278,716 | 7,841,704 |
| 7,524,028 | 7,467,856 | 7,448,729 | 7,246,876 | 7,431,431 |
| 7,419,249 | 7,377,623 | 7,328,978 | 7,334,876 | 7,147,306 |
| 7,261,394 | 7,654,645 | 7,784,915 | 7,721,948 | 7,079,712 |
| 6,825,945 | 7,330,974 | 6,813,039 | 6,987,506 | 7,038,797 |
| 6,980,318 | 6,816,274 | 7,102,772 | 7,350,236 | 6,681,045 |
| 6,728,000 | 7,173,722 | 7,088,459 | 7,707,082 | 7,068,382 |
| 7,062,651 | 6,789,194 | 6,789,191 | 6,644,642 | 6,502,614 |
| 6,622,999 | 6,669,385 | 6,549,935 | 6,987,573 | 6,727,996 |
| 6,591,884 | 6,439,706 | 6,760,119 | 7,295,332 | 6,290,349 |
| 6,428,155 | 6,785,016 | 6,870,966 | 6,822,639 | 6,737,591 |
| 7,055,739 | 7,233,320 | 6,830,196 | 6,832,717 | 6,957,768 |
| 7,456,820 | 7,170,499 | 7,106,888 | 7,123,239 | 7,377,608 |
| 7,399,043 | 7,121,639 | 7,165,824 | 7,152,942 | 7,818,519 |
| 7,181,572 | 7,096,137 | 7,302,592 | 7,278,034 | 7,188,282 |
| 7,592,829 | 7,770,008 | 7,707,621 | 7,523,111 | 7,573,301 |
| 7,660,998 | 7,783,886 | 7,831,827 | 7,171,323 | 7,278,697 |
| 7,360,131 | 7,519,772 | 7,328,115 | 7,369,270 | 6,795,215 |

-continued

| | | | | |
|---|---|---|---|---|
| 7,070,098 | 7,154,638 | 6,805,419 | 6,859,289 | 6,977,751 |
| 6,398,332 | 6,394,573 | 6,622,923 | 6,747,760 | 6,921,144 |
| 7,092,112 | 7,192,106 | 7,457,001 | 7,173,739 | 6,986,560 |
| 7,008,033 | 7,551,324 | 7,222,780 | 7,270,391 | 7,525,677 |
| 7,388,689 | 7,571,906 | 7,195,328 | 7,182,422 | 7,866,791 |
| 7,374,266 | 7,427,117 | 7,448,707 | 7,281,330 | 7,328,956 |
| 7,735,944 | 7,188,928 | 7,093,989 | 7,377,609 | 7,600,843 |
| 10/854,498 | 7,390,071 | 7,549,715 | 7,252,353 | 7,607,757 |
| 7,267,417 | 7,517,036 | 7,275,805 | 7,314,261 | 7,281,777 |
| 7,290,852 | 7,484,831 | 7,758,143 | 7,832,842 | 7,549,718 |
| 7,866,778 | 7,631,190 | 7,557,941 | 7,757,086 | 7,266,661 |
| 7,243,193 | 7,163,345 | 7,322,666 | 7,566,111 | 11/544,764 |
| 7,819,494 | 11/544,772 | 11/544,774 | 7,845,747 | 7,425,048 |
| 11/544,766 | 7,780,256 | 7,384,128 | 7,604,321 | 7,722,163 |
| 7,381,970 | 7,425,047 | 7,413,288 | 7,465,033 | 7,452,055 |
| 7,470,002 | 7,722,161 | 7,475,963 | 7,448,735 | 7,465,042 |
| 7,448,739 | 7,438,399 | 7,467,853 | 7,461,922 | 7,465,020 |
| 7,722,185 | 7,461,910 | 7,270,494 | 7,632,032 | 7,475,961 |
| 7,547,088 | 7,611,239 | 7,735,955 | 7,758,038 | 7,681,876 |
| 7,780,161 | 7,703,903 | 7,703,900 | 7,703,901 | 7,722,170 |
| 7,857,441 | 7,784,925 | 7,794,068 | 7,448,734 | 7,425,050 |
| 7,364,263 | 7,201,468 | 7,360,868 | 7,234,802 | 7,303,255 |
| 7,287,846 | 7,156,511 | 7,258,432 | 7,097,291 | 7,645,025 |
| 7,083,273 | 7,367,647 | 7,374,355 | 7,441,880 | 7,547,092 |
| 7,513,598 | 7,198,352 | 7,364,264 | 7,303,251 | 7,201,470 |
| 7,121,655 | 7,293,861 | 7,232,208 | 7,328,985 | 7,344,232 |
| 7,083,272 | 7,311,387 | 7,303,258 | 7,621,620 | 7,669,961 |
| 7,331,663 | 7,360,861 | 7,328,973 | 7,427,121 | 7,407,262 |
| 7,303,252 | 7,249,822 | 7,537,309 | 7,311,382 | 7,360,860 |
| 7,364,257 | 7,390,075 | 7,350,896 | 7,429,096 | 7,384,135 |
| 7,331,660 | 7,416,287 | 7,488,052 | 7,322,684 | 7,322,685 |
| 7,311,381 | 7,270,405 | 7,303,268 | 7,470,007 | 7,399,072 |
| 7,393,076 | 7,681,967 | 7,588,301 | 7,249,833 | 7,524,016 |
| 7,490,927 | 7,331,661 | 7,524,043 | 7,300,140 | 7,357,492 |
| 7,357,493 | 7,566,106 | 7,380,902 | 7,284,816 | 7,284,845 |
| 7,255,430 | 7,390,080 | 7,328,984 | 7,350,913 | 7,322,671 |
| 7,380,910 | 7,431,424 | 7,470,006 | 7,585,054 | 7,347,534 |
| 7,441,865 | 7,469,989 | 7,367,650 | 7,469,990 | 7,441,882 |
| 7,556,364 | 7,357,496 | 7,467,863 | 7,431,440 | 7,431,443 |
| 7,527,353 | 7,524,023 | 7,513,603 | 7,467,852 | 7,465,045 |
| 7,645,034 | 7,637,602 | 7,645,033 | 7,661,803 | 7,841,708 |
| 7,079,292 | | | | |

BACKGROUND OF THE INVENTION

Inkjet printing is a popular and versatile form of print imaging. The Assignee has developed printers that eject ink through MEMS printhead IC's. These printhead IC's (integrated circuits) are formed using lithographic etching and deposition techniques used for semiconductor fabrication.

The micro-scale nozzle structures in MEMS printhead IC's allow a high nozzle density (nozzles per unit of IC surface area), high print resolutions, low power consumption, self cooling operation and therefore high print speeds. Such printheads are described in detail in U.S. Ser. No. 10/160,273 (MJ40US) and U.S. Ser. No. 10/728,804 (MTB001US) to the present Assignee. The disclosures of these documents are incorporated herein by reference.

The small nozzle structures and high nozzle densities can create difficulties with nozzle clogging, de-priming, nozzle drying (decap), color mixing, nozzle flooding, bubble contamination in the ink stream and so on. Each of these issues can produce artifacts that are detrimental to the print quality. The component parts of the printer are designed to minimize the risk that these problems will occur. The optimum situation would be printer components whose inherent function is able to preclude these problem issues from arising. In reality, the many different types of operating conditions, and mishaps or unduly rough handling during transport or day to day operation, make it impossible to address the above problems via the 'passive' control of component design, material selection and so on.

SUMMARY OF THE INVENTION

According to a first aspect, the present invention provides an inkjet printer comprising:

an ink supply;

a printhead integrated circuit (IC) in fluid communication with the ink supply via an upstream ink line, the printhead IC having an array of nozzles each with respective actuators for ejecting drops of ink onto print media;

a waste ink outlet in fluid communication with the printhead IC via a downstream ink line;

an upstream shut off valve in the upstream ink line; and, a downstream pump mechanism in the downstream ink line.

The invention gives the user active control of the ink flows from the ink reservoir to the nozzles of the printhead IC with the addition of a simple pump and valve. In the event that problems such as ink flooding, color mixing or printhead depriming occur, the user can follow simple troubleshooting protocols to rectify the situation.

Optionally, the pump mechanism is reversible for pumping ink toward the waste ink outlet or toward the ink manifold. Preferably, the pump mechanism is a peristaltic pump.

Optionally, the printer further comprises a pressure regulator upstream of the printhead IC for maintaining ink in the nozzles at a hydrostatic pressure less than atmospheric pressure. Preferably, the ink supply is an ink tank upstream of the shut off valve, and the pressure regulator is positioned in the ink tank. In a further preferred form, the pressure regulator is a bubble point regulator which has an air bubble outlet submerged in the ink in the ink tank, and an air inlet vented to atmosphere such that any reduction of hydrostatic pressure in the in the ink tank because of ink consumption draws air through the air inlet to form bubbles at the bubble outlet and keep the pressure in the ink tank substantially constant.

Optionally, the printer further comprises a filter upstream of the printhead IC for removing particulates from the ink. Preferably, the ink tank has an outlet in sealed fluid communication with the shut off valve and the filter is positioned in the ink tank, covering the outlet. In a particularly preferred form, the ink tank is a removable ink cartridge and the outlet can releasably engage the upstream ink line.

Optionally, the shut off valve is biased shut and returns to its shut position when the printer is powered down (switched off or in power save stand-by mode). Preferably, the shut off valve displaces ink when moving to its shut position such that when the shut off valves opens, a finite volume of ink is drawn away from the ink tank to drop the hydrostatic pressure at the bubble outlet toward the bubble point pressure.

Optionally, the printer further comprises a capper that is movable between an unsealed position spaced from the nozzles of the printhead IC and a sealed position creating an air tight seal over the nozzles. Preferably, the array of nozzles is formed in a nozzle plate and the capper is configured to remove ink and particulates deposited on the nozzle plate.

Optionally, the printer further comprises a sensor downstream of the printhead IC for sensing the presence or absence of ink. Preferably, the sensor is upstream of the peristaltic pump. In a particularly preferred form, the printer has a plurality of the ink tanks for separate ink colors, and a plurality of upstream ink lines and downstream ink lines for each colour respectively, wherein the peristaltic pump is a multi-channel peristaltic pump that can pump each ink color simultaneously. Preferred embodiments may further comprise a controller operatively linked to the sensor and the peristaltic pump such that the controller operates the pump in response to output from the sensor. Optionally, the waste ink outlet leads to a sump.

According to a second aspect, the present invention provides a printhead assembly for installation in an inkjet printer, the printhead assembly comprising:

a printhead integrated circuit (IC) having an array of nozzles each with respective actuators for ejecting drops of ink onto print media;

an upstream ink line in fluid communication with the printhead IC, the upstream ink line being configured for releasable engagement with an ink supply;

a downstream ink line in fluid communication with the printhead IC;

a waste ink outlet in fluid communication with the printhead IC via the downstream ink line;

an upstream shut off valve in the upstream ink line; and, a downstream pump mechanism in the downstream ink line.

Optionally, the pump mechanism is reversible for pumping ink toward the waste ink outlet or toward the printhead IC. Preferably, the pump mechanism is a peristaltic pump.

Optionally the ink supply is an ink cartridge and the upstream ink line is configured for releasable sealed fluid engagement with an outlet on the ink cartridge.

Optionally, the shut off valve is biased shut and returns to its shut position when the printhead assembly is installed in the printer and the printer is powered down (switched off or in power save stand-by mode). Preferably, the shut off valve displaces ink when moving to its shut position such that when the shut off valves opens, a finite volume of ink is drawn away from the ink cartridge to drop the hydrostatic pressure at the outlet of the ink cartridge.

Optionally, the printhead assembly further comprises a capper that is movable between an unsealed position spaced from the nozzles of the printhead IC and a sealed position creating an air tight seal over the nozzles. Preferably, the array of nozzles is formed in a nozzle plate and the capper is configured to remove ink and particulates deposited on the nozzle plate.

Optionally, the printhead assembly further comprises a sensor downstream of the ink manifold for sensing the presence or absence of ink. Preferably, the sensor is upstream of the peristaltic pump. In a particularly preferred form, the printer has a plurality of the ink tanks for separate ink colors, and a plurality of upstream ink lines and downstream ink lines for each colour respectively, wherein the peristaltic pump is a multi-channel peristaltic pump that can pump each ink color simultaneously. Preferred embodiments may further comprise a controller operatively linked to the sensor and the peristaltic pump such that the controller operates the pump in response to output from the sensor. Optionally, the waste ink outlet connects to a sump in the printer.

According to a third aspect, the present invention provides a printhead assembly for an inkjet printer, the printhead assembly comprising:

a printhead integrated circuit (IC) with an array of nozzles for ejecting ink onto print media; and, a shut off valve having:

a valve body defining an ink inlet for connection to an ink supply, an ink outlet connected to the printhead IC, and a valve seat;

a valve member biased into sealing engagement with the valve seat to provide a fluid seal between the ink inlet and the ink outlet; and, an actuator for unsealing the valve member from the valve seat upon energizing and re-sealing the valve member to the valve seat when de-energized.

The invention protects the ink in the ink supply from contaminants that can migrate up the ink line during shut down periods. The valve member is constantly biased to a closed position and so seals the ink supply from the printhead IC as a default condition even in the event of a power failure. The bias is strong enough to provide the fluid seal so that the seal is not compromised when the pressure difference between the inlet and the outlet is small.

Preferably, the valve member has a diaphragm, and the ink outlet and the ink inlet are both in fluid communication with one side of the diaphragm, such that unsealing the valve member draws the diaphragm away from the valve seat to lower the fluid pressure in the ink inlet and the ink outlet. In a further preferred form, the diaphragm is under residual tension when biasing the valve member into sealing engagement with the valve seat. Optionally, the actuator works against the bias of the diaphragm to unseal the valve member from the valve seat. Optionally, the actuator has a solenoid. Optionally, the actuator has a shape memory alloy. Optionally, the shape memory alloy comprises a Nitinol™ wire. Optionally the diaphragm is polyurethane.

Preferably the actuator draws the diaphragm away from the valve seat more quickly than the diaphragm reseals the valve member to the valve seat. In a further preferred form, the valve seat has a frusto-conical surface for sealing against a complementary surface extending from one side of the diaphragm.

According to a fourth aspect, the present invention provides an inkjet printer comprising:

an ink supply;

a printhead integrated circuit (IC) in fluid communication with the ink supply via an upstream ink line, the printhead IC having an array of nozzles each with respective actuators for ejecting drops of ink onto print media;

a waste ink outlet in fluid communication with the printhead IC via a downstream ink line;

an upstream pump mechanism in the upstream ink line;

a downstream pump mechanism in the downstream ink line; and, user controls to selectively activate the upstream pump mechanism and the down stream pump mechanism.

Giving the printer user the ability to selectively pump ink through the fluidic architecture both upstream and down stream of the printhead IC, allows many of the problems associated with MEMS printheads to be corrected after they occur. In light of this, it is not as crucial that the printer components themselves safeguard against issues such as deprime, color mixing and outgassing. An active control system for the ink flow through the printer means that the user can prime, deprime, or purge the printhead IC. Also, the upstream line can be deprimed and/or the downstream line can be deprimed (and of course subsequently re-primed). This control system allows the user to correct and print artifact causing conditions as and when they occur.

Preferably, the upstream ink line has an upstream bypass line around the upstream pump mechanism, the upstream bypass line having an upstream shutoff valve.

Preferably, the downstream ink line has a downstream bypass line around the downstream pump mechanism, the downstream bypass line having a downstream shutoff valve.

Preferably, the waste ink outlet feeds a sump for storing waste ink in the printer.

Preferably, the user controls can selectively open and shut the upstream and downstream shutoff valves.

Preferably, the upstream and downstream pump mechanisms are reversible so that they can pump ink in either direction in the upstream and downstream ink lines respectively.

Preferably, the upstream ink line terminates at an LCP moulding to which the printhead IC is mounted, and the downstream ink line starts at the LCP moulding.

Preferably, the upstream pump mechanism and the downstream pump mechanism are provided by separate fluid lines running through a single fluid pump.

Preferably the fluid pump is a peristaltic pump.

Preferably the upstream ink line and the downstream ink line have an additional shutoff valve upstream of the fluid pump.

Alternatively, the upstream bypass valve and the downstream bypass valve are each substituted for a 3-way valve at the 3-way junctions upstream of the fluid pump in both the upstream and downstream ink lines.

According to a fifth aspect, the present invention provides an ink distribution member for providing ink from an ink supply to a printhead IC and a waste ink outlet, the distribution member comprising:

a series of ink conduits, each ink conduit having an aperture for fluid communication with associated nozzles in the printhead IC, an upstream section extending from the aperture towards the ink supply and a downstream section extending from the aperture to the waste ink outlet; wherein, each of the ink conduits is geometrically profiled such that any gas bubbles extending across one if the ink conduits is urged from the upstream section towards the downstream section.

Outgassing from the ink into the small conduits of the LCP moulding can create readily visible artifacts in the print. Using an ink distribution member that has profiled conduits that use capillarity or other means to draw bubble into the downstream ink line, will help to minimize bubble contamination of the printhead IC. It can also be used to promote the preferential filling of conduits containing larger ink bubbles over those with smaller ink bubbles so that priming occurs more uniformly.

Preferably, the ink conduits are geometrically profiled so that they taper in at least one cross sectional dimension from the downstream section to the start of the upstream section.

Preferably, the ink conduits are geometrically profiled so that capillarity effects urge the gas bubbles from the upstream section to the downstream section.

Preferably, the upstream section is shorter than the downstream section.

Preferably, the ink conduit is profiled such that gas bubble are drawn passed the aperture and into the downstream section.

Preferably ink distribution member is an LCP moulding.

BRIEF DESCRIPTION OF THE DRAWINGS

Preferred embodiments of the invention will now be described by way of example only with reference to the accompanying drawings, in which.

DETAILED DESCRIPTION OF PREFERRED EMBODIMENTS

The printers using prior art types of fluid architecture are exemplified by the disclosure in the Assignee's co-pending U.S. Ser. No. 11/014,769 which is incorporated herein by cross reference. For context, the printhead assembly from this printer design will be described before the embodiments of the present invention.

Printhead Assembly

Figures 10, 11:
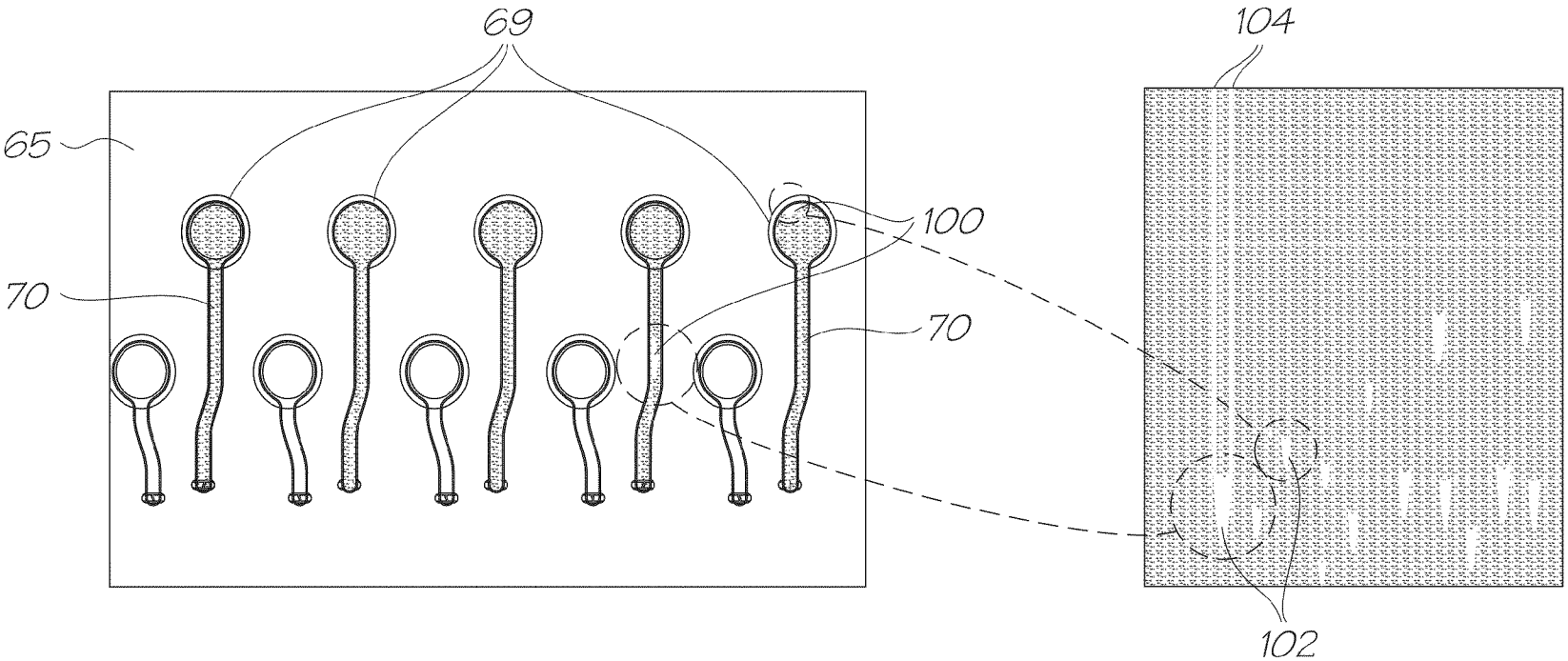
FIG. 10 is an enlarged view of gas bubbles in the conduits of the LCP moulding.
FIG. 11 is a sketch of the artifacts that can result from bubble contamination of the ink lines.

The printhead assembly 22 shown in FIGS. 1 to 4 is adapted to be attached to the underside of the main body 20 to receive ink from the outlets molding 27 (see FIG. 10 of U.S. Ser. No. 11/014,769, cross referenced above).

The printhead assembly 22 generally comprises an elongate upper member 62 which is configured to extend beneath the main body 20 between the posts 26. U-shaped clips 63 project from the upper member 62. These pass through the recesses 37 provided in the rigid plate 34 and become captured by lugs (not shown) formed in the main body 20 to secure the printhead assembly 22.

The upper element 62 has a plurality of feed tubes 64 that are received within the outlets in the outlet molding 27 when the printhead assembly 22 secures to the main body 20. The feed tubes 64 may be provided with an outer coating to guard against ink leakage.

The upper member 62 is made from a liquid crystal polymer (LCP) which offers a number of advantages. It can be molded so that its coefficient of thermal expansion (CTE) is similar to that of silicon. It will be appreciated that any significant difference in the CTE's of the printhead integrated circuit 74 (discussed below) and the underlying moldings can cause the entire structure to bow. However, as the CTE of LCP in the mold direction is much less than that in the non-mold direction (~5 ppm/° C. compared to ~20 ppm/° C.), care must be take to ensure that the mold direction of the LCP moldings is unidirectional with the longitudinal extent of the printhead integrated circuit (IC) 74. LCP also has a relatively high stiffness with a modulus that is typically 5 times that of 'normal plastics' such as polycarbonates, styrene, nylon, PET and polypropylene.

Figure 1:
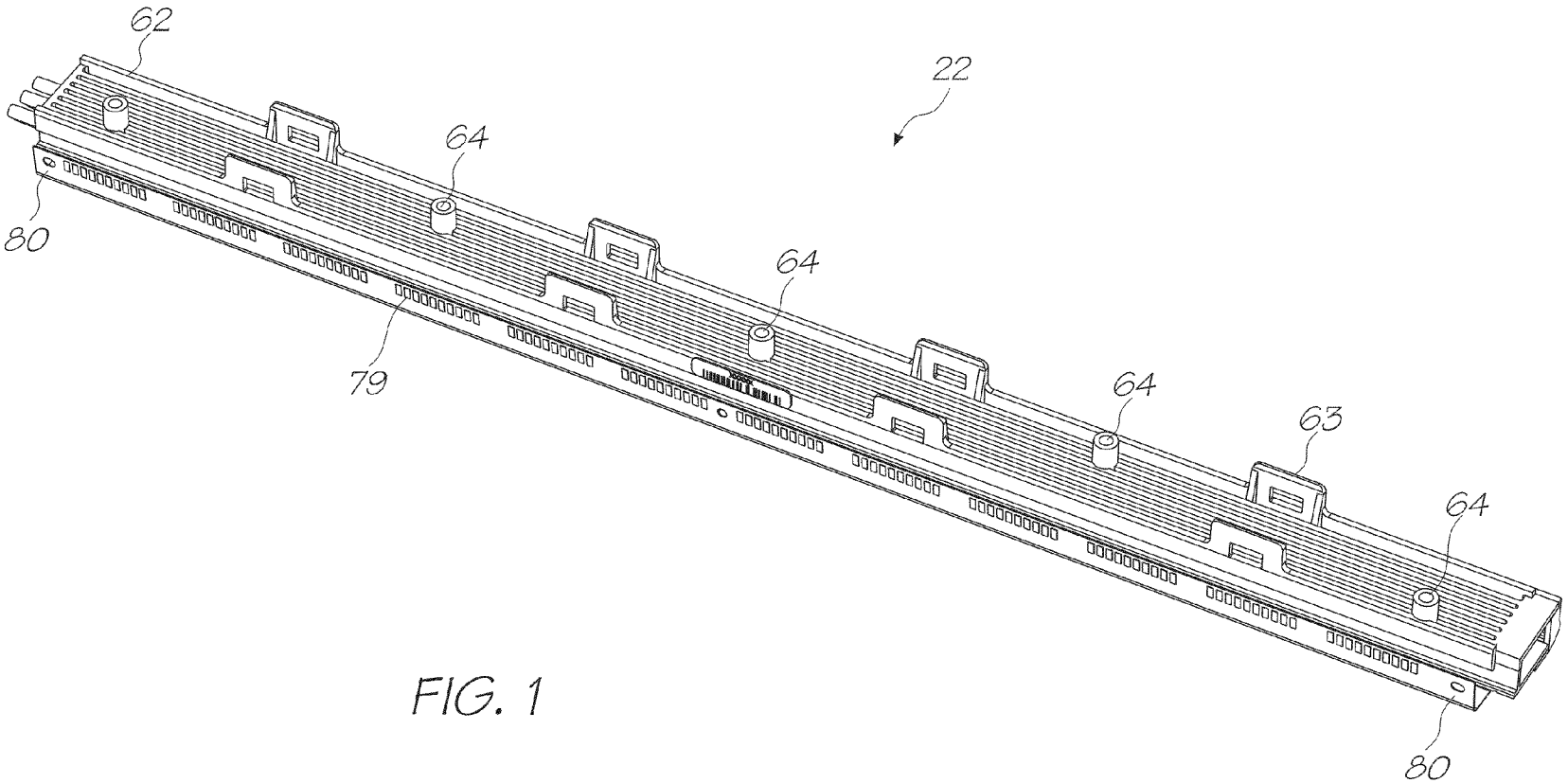
FIG. 1 shows a top perspective view of a prior art printhead assembly.
Figure 2:
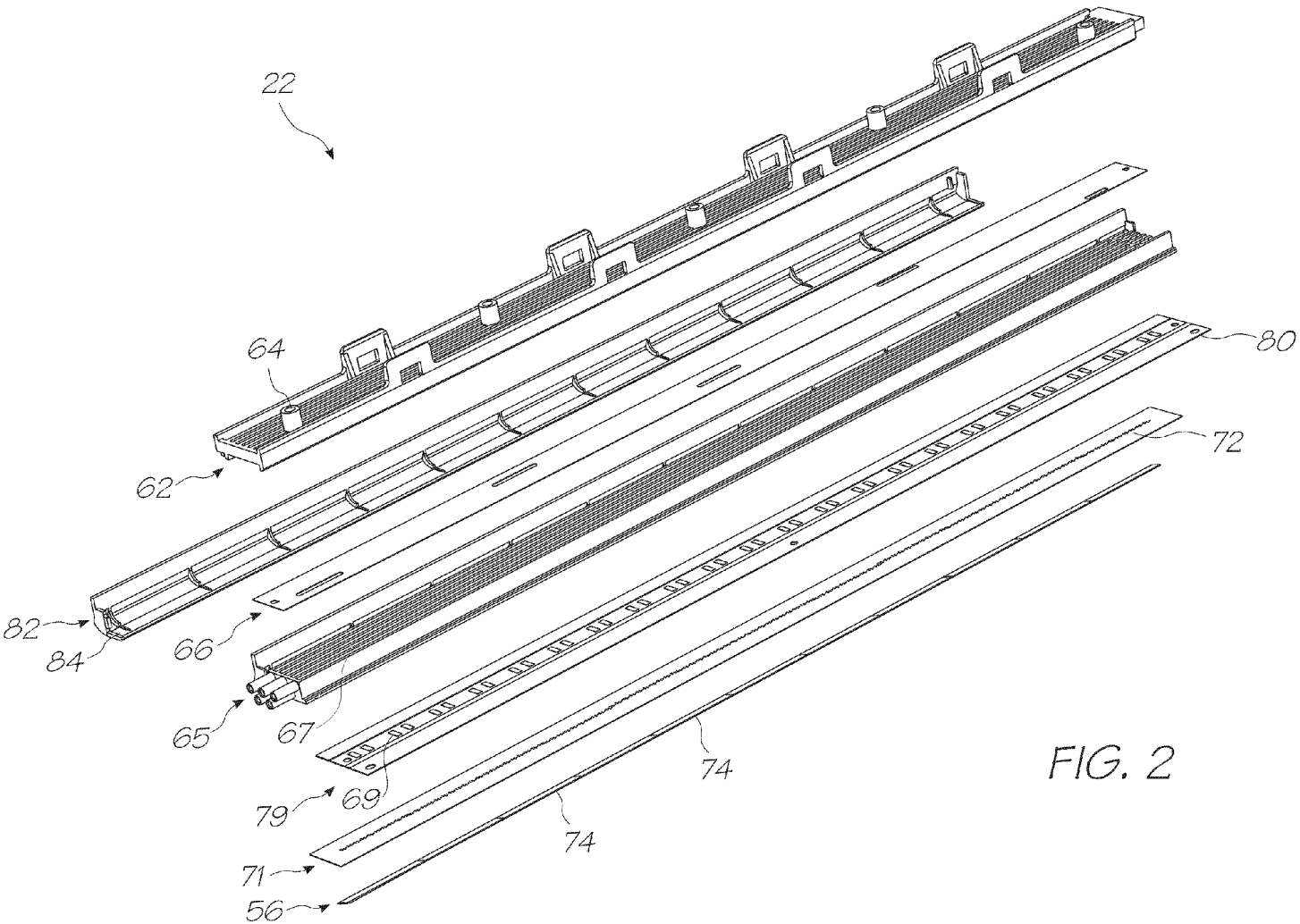
FIG. 2 shows an exploded view of the printhead assembly shown in FIG. 1.

As best shown in FIG. 2, upper member 62 has an open channel configuration for receiving a lower member 65, which is bonded thereto, via an adhesive film 66. The lower member 65 is also made from an LCP and has a plurality of ink channels 67 formed along its length. Each of the ink channels 67 receive ink from one of the feed tubes 64, and distribute the ink along the length of the printhead assembly 22. The channels are 1 mm wide and separated by 0.75 mm thick walls.

In the embodiment shown, the lower member 65 has five channels 67 extending along its length. Each channel 67 receives ink from only one of the five feed tubes 64, which in turn receives ink from one of the ink storage modules 45 (see FIG. 10 of U.S. Ser. No. 11/014,769, cross referenced above) to reduce the risk of mixing different colored inks. In this regard, adhesive film 66 also acts to seal the individual ink channels 67 to prevent cross channel mixing of the ink when the lower member 65 is assembled to the upper member 62.

Figure 8:
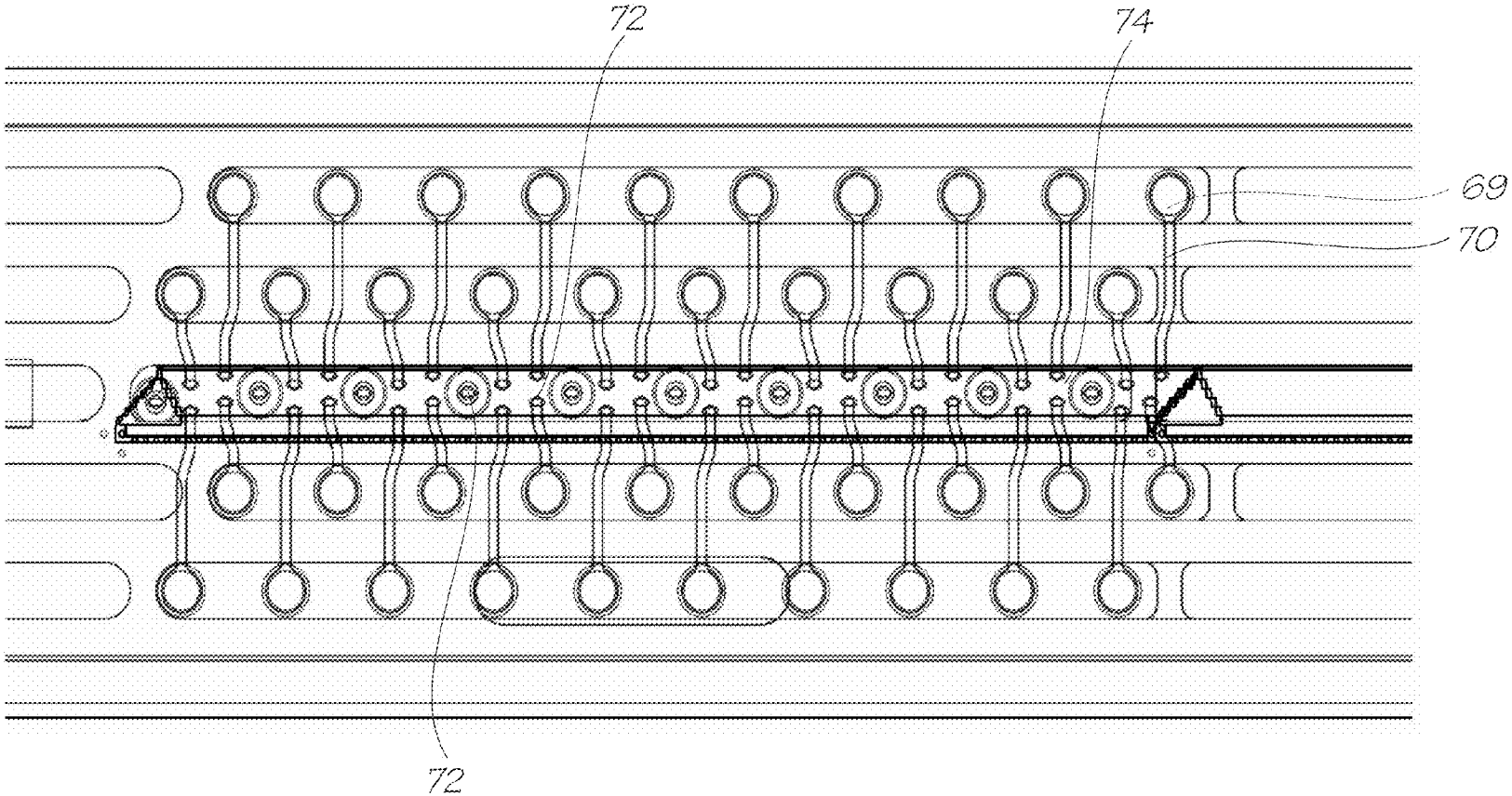
FIG. 8 shows a transparent top view of a printhead assembly of FIG. 15 showing in particular, the ink conduits for supplying ink to the printhead integrated circuits.

In the bottom of each channel 67 are a series of equi-spaced holes 69 (best seen in FIG. 3) to give five rows of holes 69 in the bottom surface of the lower member 65. The middle row of holes 69 extends along the centre-line of the lower member 65, directly above the printhead IC 74. As best seen in FIG. 8, other rows of holes 69 on either side of the middle row need conduits 70 from each hole 69 to the centre so that ink can be fed to the printhead IC 74.

Figure 3:
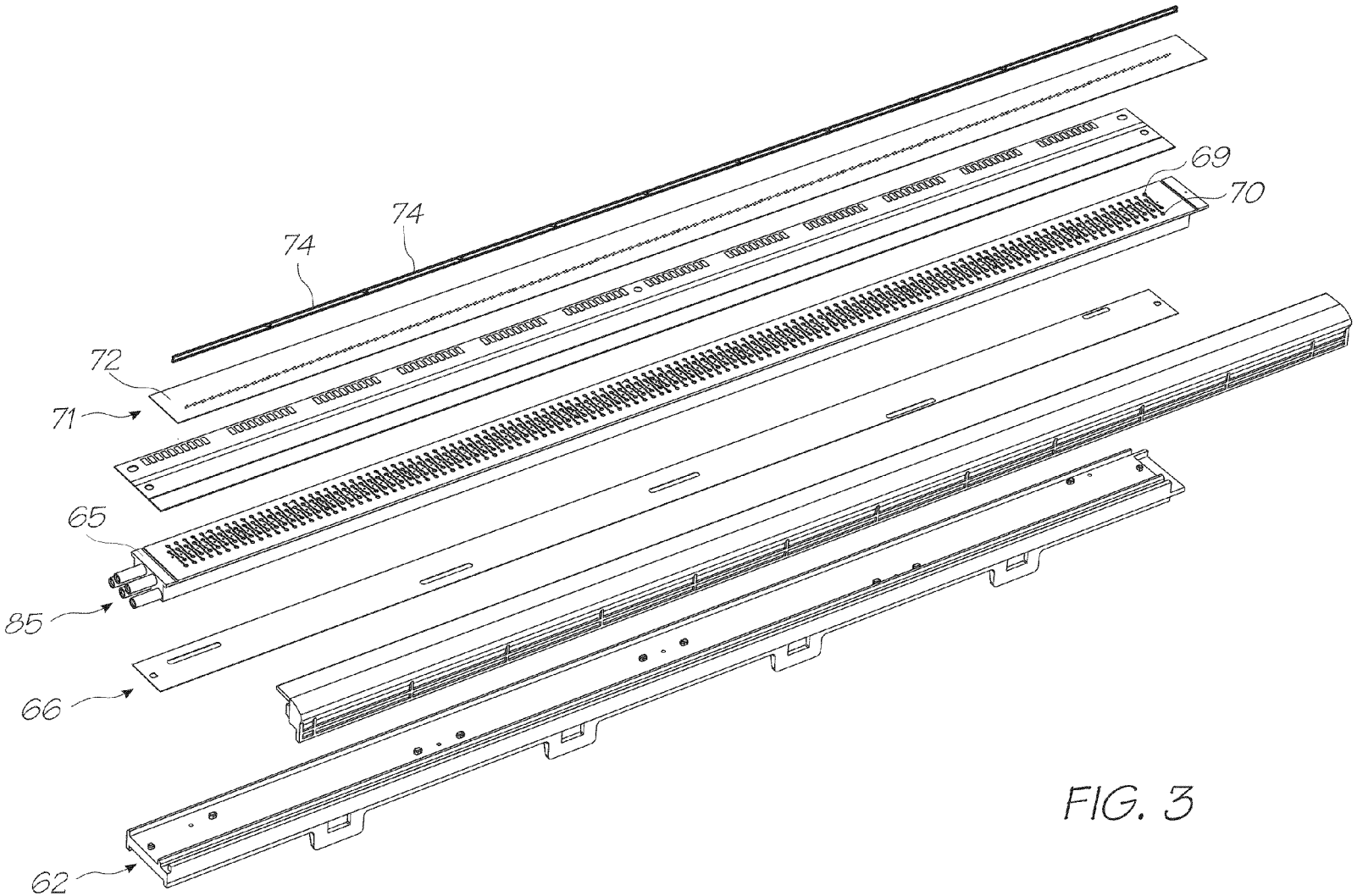
FIG. 3 shows an inverted exploded view of the printhead assembly shown in FIG. 1.
Figure 4:
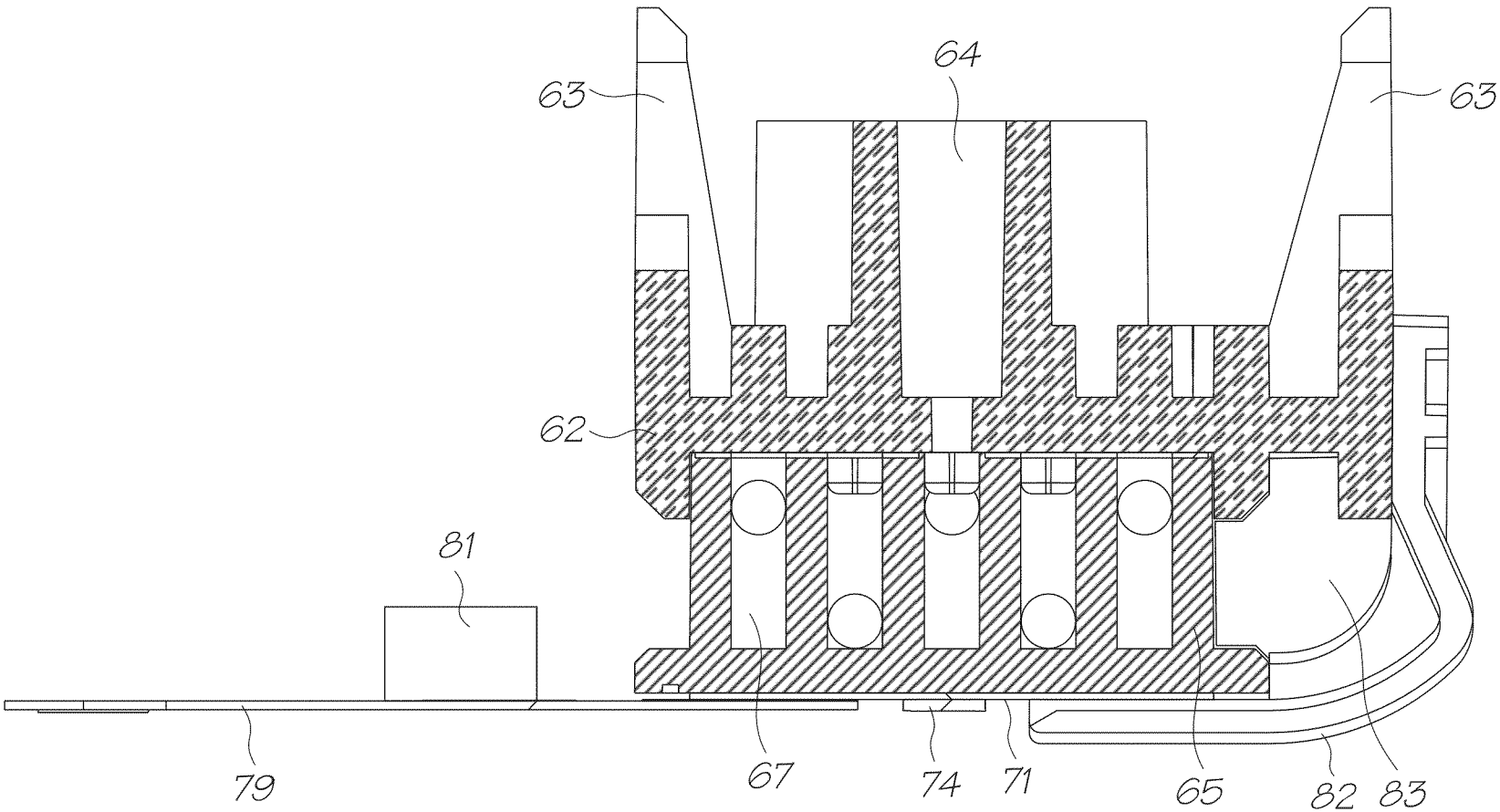
FIG. 4 shows a cross-sectional end view of the printhead assembly of FIG. 1.
Figure 9:
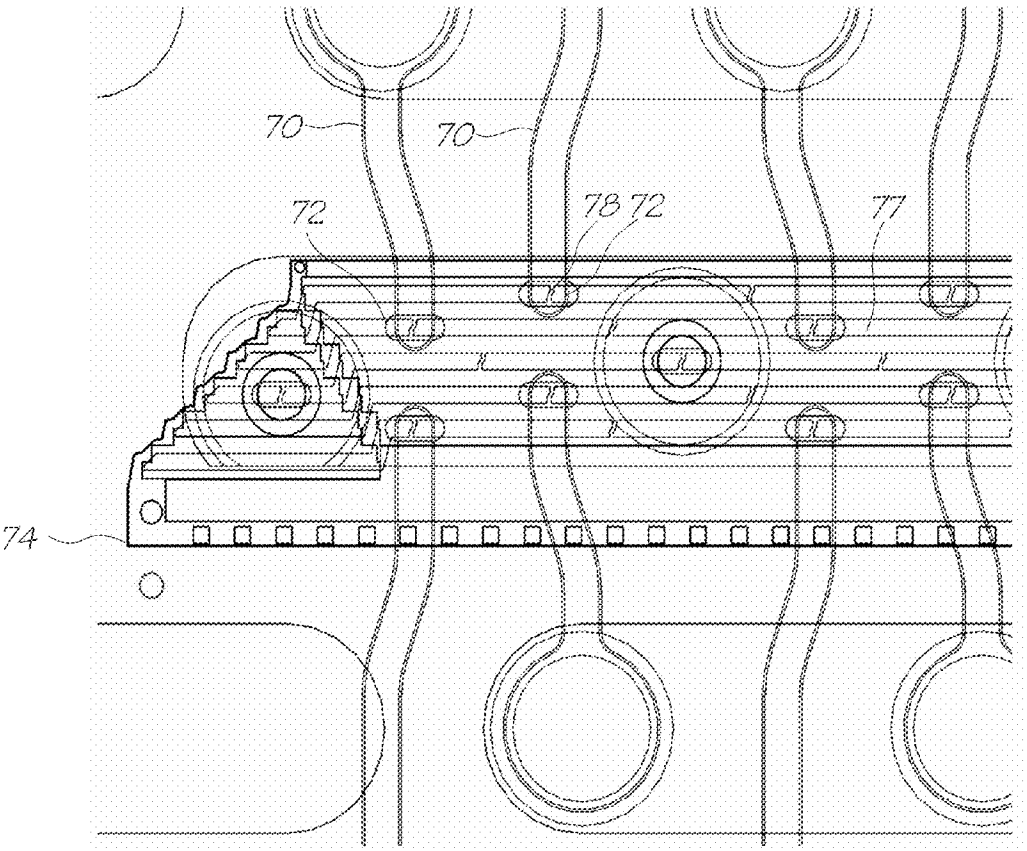
FIG. 9 is a partial enlargement of FIG. 8.

Referring to FIG. 4, the printhead IC 74 is mounted to the underside of the lower member 65 by a polymer sealing film 71. This film may be a thermoplastic film such as a PET or Polysulphone film, or it may be in the form of a thermoset film, such as those manufactured by AL technologies and Rogers Corporation. The polymer sealing film 71 is a laminate with adhesive layers on both sides of a central film, and laminated onto the underside of the lower member 65. As shown in FIGS. 3, 8 and 9, a plurality of holes 72 are laser drilled through the adhesive film 71 to coincide with the centrally disposed ink delivery points (the middle row of holes 69 and the ends of the conduits 70) for fluid communication between the printhead IC 74 and the channels 67.

Figure 7:
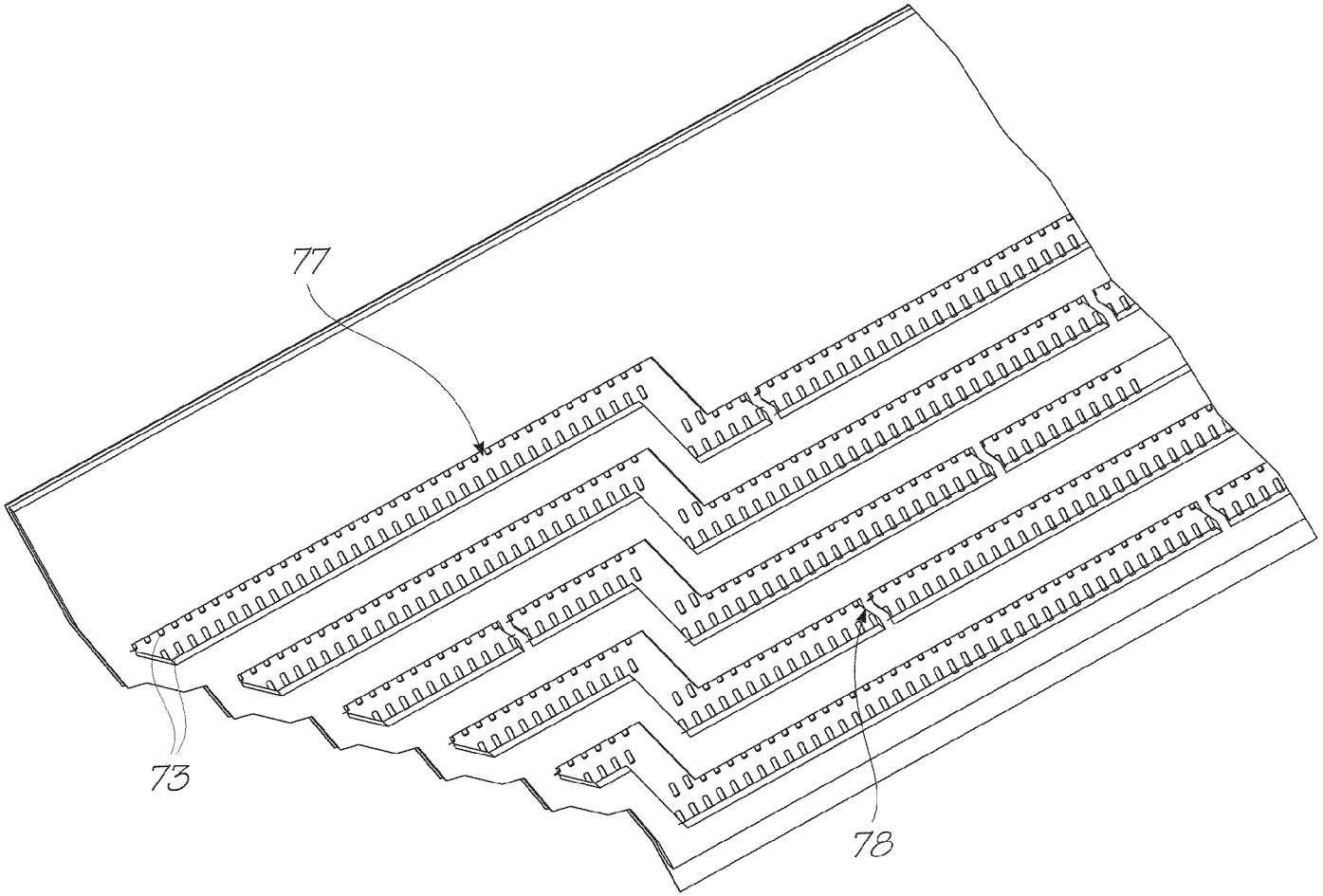
FIG. 7 shows an underside view of the printhead integrated circuit shown in FIG. 5.

The thickness of the polymer sealing film 71 is critical to the effectiveness of the ink seal it provides. As best seen in FIGS. 7 and 8, the polymer sealing film seals the etched channels 77 on the reverse side of the printhead IC 74, as well as the conduits 70 on the other side of the film. However, as the film 71 seals across the open end of the conduits 70, it can also bulge or sag into the conduit. The section of film that sags into a conduit 70 runs across several of the etched channels 77 in the printhead IC 74. The sagging may cause a gap between the walls separating each of the etched channels 77. Obviously, this breaches the seal and allows ink to leak out of the printhead IC 74 and or between etched channels 77.

To guard against this, the polymer sealing film 71 should be thick enough to account for any sagging into the conduits 70 while maintaining the seal over the etched channels 77. The minimum thickness of the polymer sealing film 71 will depend on:

1. the width of the conduit into which it sags;
2. the thickness of the adhesive layers in the film's laminate structure;
3. the 'stiffness' of the adhesive layer as the printhead IC 74 is being pushed into it; and,
4. the modulus of the central film material of the laminate.

A polymer sealing film 71 thickness of 25 microns is adequate for the printhead assembly 22 shown. However, increasing the thickness to 50, 100 or even 200 microns will correspondingly increase the reliability of the seal provided.

Ink delivery inlets 73 are formed in the 'front' surface of a printhead IC 74. The inlets 73 supply ink to respective nozzles (described in FIGS. 23 to 36 of U.S. Ser. No. 11/014,769, cross referenced above) positioned on the inlets. The ink must be delivered to the IC's so as to supply ink to each and every individual inlet 73. Accordingly, the inlets 73 within an individual printhead IC 74 are physically grouped to reduce ink supply complexity and wiring complexity. They are also grouped logically to minimize power consumption and allow a variety of printing speeds.

Figure 5:
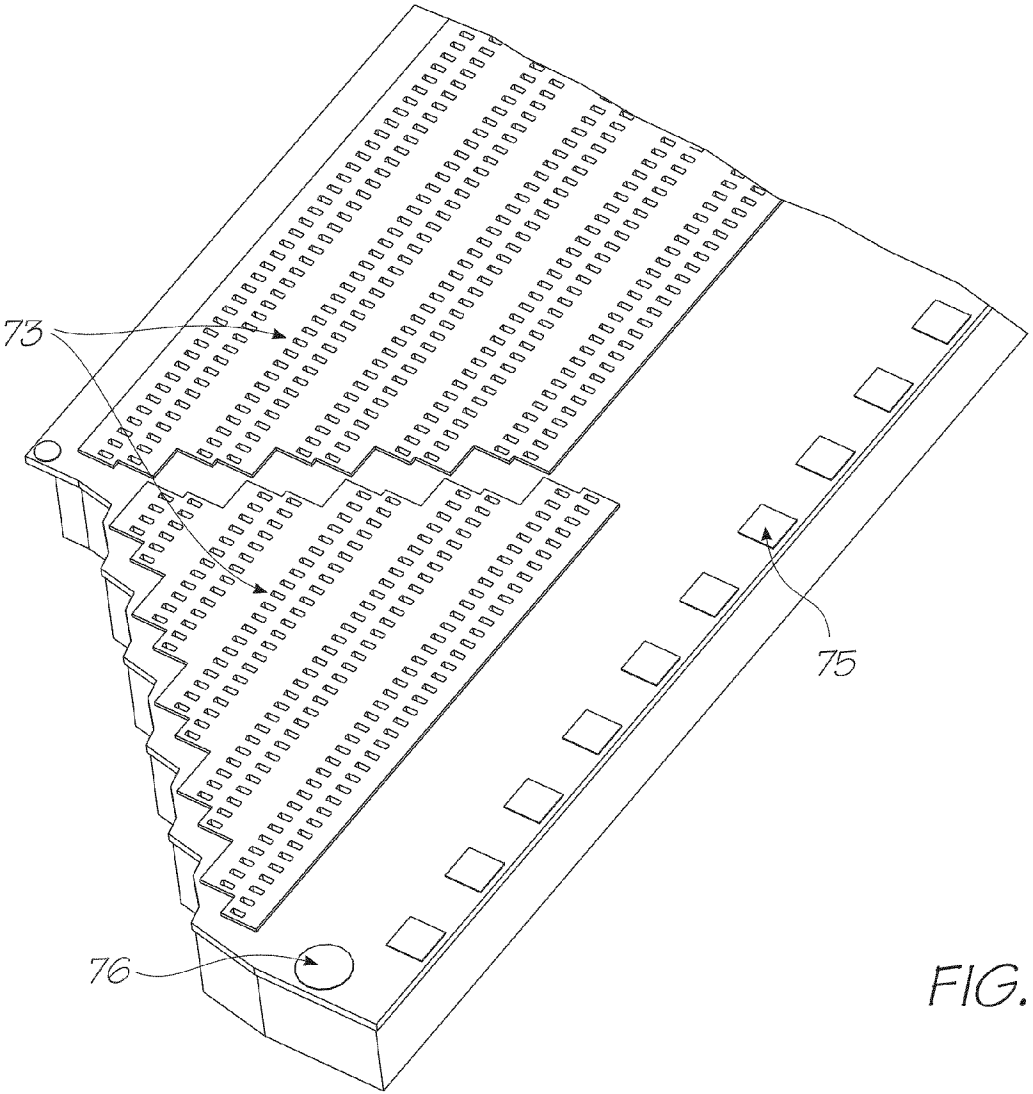
FIG. 5 shows a magnified partial perspective view of the drop triangle end of a printhead integrated circuit module as shown in FIGS. 2 to 4.

Each printhead IC 74 is configured to receive and print five different colours of ink (C, M, Y, K and IR) and contains 1280 ink inlets per colour, with these nozzles being divided into even and odd nozzles (640 each). Even and odd nozzles for each colour are provided on different rows on the printhead IC 74 and are aligned vertically to perform true 1600 dpi printing, meaning that nozzles 801 are arranged in 10 rows, as clearly shown in FIG. 5. The horizontal distance between two adjacent nozzles 801 on a single row is 31.75 microns, whilst the vertical distance between rows of nozzles is based on the firing order of the nozzles, but rows are typically separated by an exact number of dot lines, plus a fraction of a dot line corresponding to the distance the paper will move between row firing times. Also, the spacing of even and odd rows of nozzles for a given colour must be such that they can share an ink channel, as will be described below.

As alluded to previously, the present invention is related to page-width printing and as such the printhead ICs 74 are arranged to extend horizontally across the width of the printhead assembly 22. To achieve this, individual printhead ICs 74 are linked together in abutting arrangement across the surface of the adhesive layer 71, as shown in FIGS. 2 and 3. The printhead IC's 74 may be attached to the polymer sealing film 71 by heating the IC's above the melting point of the adhesive layer and then pressing them into the sealing film 71, or melting the adhesive layer under the IC with a laser before pressing them into the film. Another option is to both heat the IC (not above the adhesive melting point) and the adhesive layer, before pressing it into the film 71.

The length of an individual printhead IC 74 is around 20-22 mm. To print an A4/US letter sized page, 11-12 individual printhead ICs 74 are contiguously linked together. The number of individual printhead ICs 74 may be varied to accommodate sheets of other widths.

Figure 6:
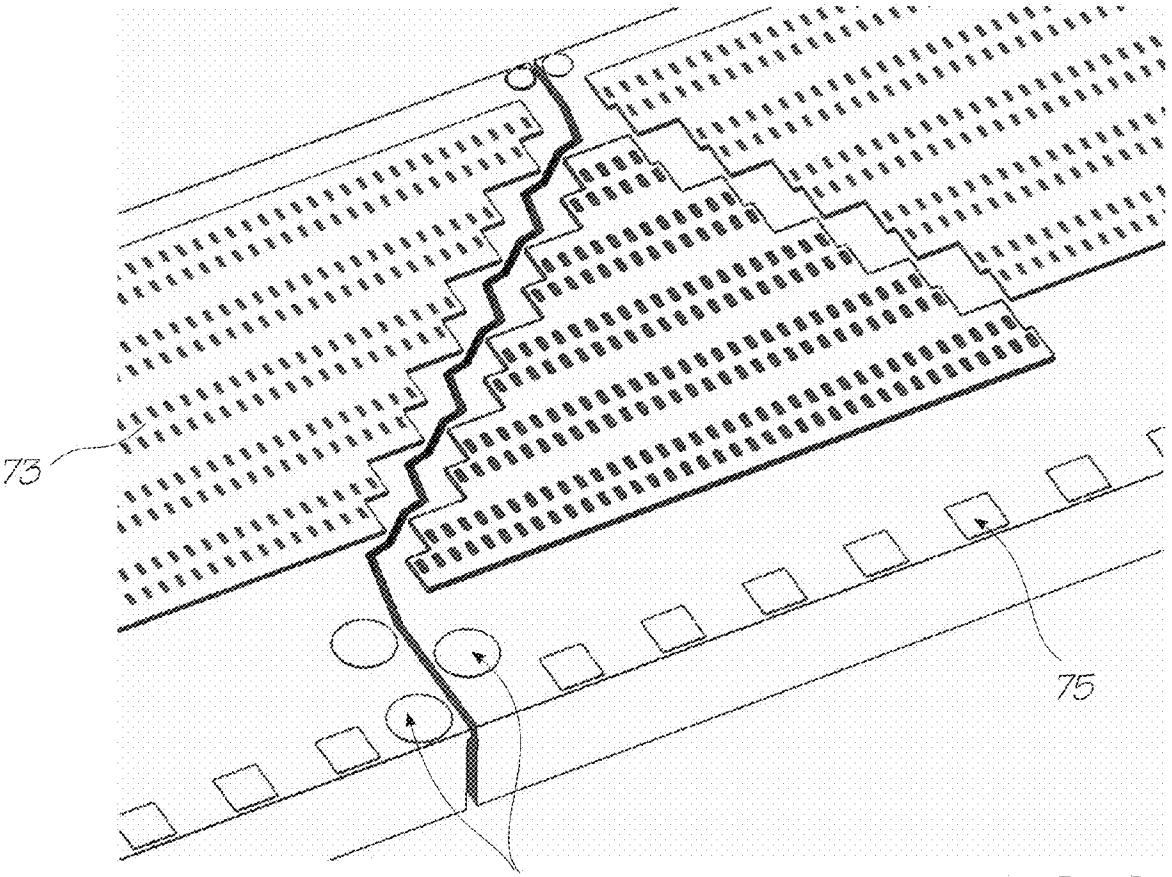
FIG. 6 shows a magnified perspective view of the join between two printhead integrated circuit modules shown in FIGS. 2 to 5.

The printhead ICs 74 may be linked together in a variety of ways. One particular manner for linking the ICs 74 is shown in FIG. 6. In this arrangement, the ICs 74 are shaped at their ends to link together to form a horizontal line of ICs, with no vertical offset between neighboring ICs. A sloping join is provided between the ICs having substantially a 45° angle. The joining edge is not straight and has a sawtooth profile to facilitate positioning, and the ICs 74 are intended to be spaced about 11 microns apart, measured perpendicular to the joining edge. In this arrangement, the left most ink delivery nozzles 73 on each row are dropped by 10 line pitches and arranged in a triangle configuration. This arrangement provides a degree of overlap of nozzles at the join and maintains the pitch of the nozzles to ensure that the drops of ink are delivered consistently along the printing zone. This arrangement also ensures that more silicon is provided at the edge of the IC 74 to ensure sufficient linkage. Whilst control of the operation of the nozzles is performed by the SoPEC device (discussed later in of U.S. Ser. No. 11/014,769, cross referenced above), compensation for the nozzles may be performed in the printhead, or may also be performed by the SoPEC device, depending on the storage requirements. In this regard it will be appreciated that the dropped triangle arrangement of nozzles disposed at one end of the IC 74 provides the minimum on-printhead storage requirements. However where storage requirements are less critical, shapes other than a triangle can be used, for example, the dropped rows may take the form of a trapezoid.

The upper surface of the printhead ICs have a number of bond pads 75 provided along an edge thereof which provide a means for receiving data and or power to control the operation of the nozzles 73 from the SoPEC device. To aid in positioning the ICs 74 correctly on the surface of the adhesive layer 71 and aligning the ICs 74 such that they correctly align with the holes 72 formed in the adhesive layer 71, fiducials 76 are also provided on the surface of the ICs 74. The fiducials 76 are in the form of markers that are readily identifiable by appropriate positioning equipment to indicate the true position of the IC 74 with respect to a neighboring IC and the surface of the adhesive layer 71, and are strategically positioned at the edges of the ICs 74, and along the length of the adhesive layer 71.

In order to receive the ink from the holes 72 formed in the polymer sealing film 71 and to distribute the ink to the ink inlets 73, the underside of each printhead IC 74 is configured as shown in FIG. 7. A number of etched channels 77 are provided, with each channel 77 in fluid communication with a pair of rows of inlets 73 dedicated to delivering one particular colour or type of ink. The channels 77 are about 80 microns wide, which is equivalent to the width of the holes 72 in the polymer sealing film 71, and extend the length of the IC 74. The channels 77 are divided into sections by silicon walls 78. Each section is directly supplied with ink, to reduce the flow path to the inlets 73 and the likelihood of ink starvation to the individual nozzles. In this regard, each section feeds approximately 128 nozzles 801 via their respective inlets 73.

FIG. 9 shows more clearly how the ink is fed to the etched channels 77 formed in the underside of the ICs 74 for supply to the nozzles 73. As shown, holes 72 formed through the polymer sealing film 71 are aligned with one of the channels 77 at the point where the silicon wall 78 separates the channel 77 into sections. The holes 72 are about 80 microns in width which is substantially the same width of the channels 77 such that one hole 72 supplies ink to two sections of the channel 77. It will be appreciated that this halves the density of holes 72 required in the polymer sealing film 71.

Following attachment and alignment of each of the printhead ICs 74 to the surface of the polymer sealing film 71, a flex PCB 79 (see FIG. 4) is attached along an edge of the ICs 74 so that control signals and power can be supplied to the bond pads 75 to control and operate the nozzles. As shown more clearly in FIG. 1, the flex PCB 79 extends from the printhead assembly 22 and folds around the printhead assembly 22.

The flex PCB 79 may also have a plurality of decoupling capacitors 81 arranged along its length for controlling the power and data signals received. As best shown in FIG. 2, the flex PCB 79 has a plurality of electrical contacts 180 formed along its length for receiving power and or data signals from the control circuitry of the cradle unit 12. A plurality of holes 80 are also formed along the distal edge of the flex PCB 79 which provide a means for attaching the flex PCB to the flange portion 40 of the rigid plate 34 of the main body 20. The manner in which the electrical contacts of the flex PCB 79 contact the power and data contacts of the cradle unit 12 will be described later.

As shown in FIG. 4, a media shield 82 protects the printhead ICs 74 from damage which may occur due to contact with the passing media. The media shield 82 is attached to the upper member 62 upstream of the printhead ICs 74 via an appropriate clip-lock arrangement or via an adhesive. When attached in this manner, the printhead ICs 74 sit below the surface of the media shield 82, out of the path of the passing media.

A space 83 is provided between the media shield 82 and the upper 62 and lower 65 members which can receive pressurized air from an air compressor or the like. As this space 83 extends along the length of the printhead assembly 22, compressed air can be supplied to the space 56 from either end of the printhead assembly 22 and be evenly distributed along the assembly. The inner surface of the media shield 82 is provided with a series of fins 84 which define a plurality of air outlets evenly distributed along the length of the media shield 82 through which the compressed air travels and is directed across the printhead ICs 74 in the direction of the media delivery. This arrangement acts to prevent dust and other particulate matter carried with the media from settling on the surface of the printhead ICs, which could cause blockage and damage to the nozzles.

Active Ink Flow Control System

The present invention gives the user a versatile control system for correcting many of the detrimental conditions that are possible during the operative life of the printer. It is also capable of preparing the printhead for transport, long term storage and re-activation. It can also allow the user to establish a desired negative pressure at the printhead IC nozzles. The control system requires easily incorporated modifications to the prior art printer designs described above.

Printhead Maintenance Requirements

The printer's maintenance system should meet several requirements:

- sealing for hydration
- sealing to exclude particulates
- drop ejection for hydration
- drop ejection for ink purge
- correction of dried nozzles
- correction of flooding
- correction of particulate fouling
- correction of outgassing
- correction of color mixing and
- correction of deprime Various mechanisms components within the printer assembly are designed with a view to minimizing any problems that the printhead maintenance system will need to address. However, it is unrealistic to expect that the design of the printer assembly components can deal with all the problems that arise for the printhead maintenance system. In relation to sealing the nozzle face for hydration and sealing the nozzles to exclude particulates the maintenance system can incorporate a capping member with a perimeter seal that will achieve these two requirements.

Drop ejection for hydration (or keep wet drops) and drop ejection for ink purge require the print engine controller (PEC) to play a roll in the overall printhead maintenance system.

The particulate fouling can be dealt with using filters positioned upstream of the printhead. However, care must be taken that small sized filters do not become too much of a flow constriction. By increasing the surface area of the filter the appropriate ink supply rate to the printhead can be maintained.

Correcting a flooded printhead will typically involve some type of blotting or wiping mechanism to remove beads of ink on the nozzle face of the printhead. Methods and systems for removing ink flooded across an ink ejection face of a printhead are described in our earlier filed U.S. application Ser. Nos. 11/246,707 ("Printhead Maintenance Assembly with Film Transport of Ink"), 11/246,706 ("Method of Maintaining a Printhead using Film Transport of Ink"), 11/246,705 ("Method of Removing Ink from a Printhead using Film Transfer"), and 11/246,708 ("Method of Removing Particulates from a Printhead using Film Transfer"), all filed on Oct. 11, 2005. The contents of each of these US applications are incorporated herein by reference.

Dried nozzles, outgassing, color mixing and nozzle deprime are more difficult to correct as they typically require a strong ink purge. Purging ink is relatively wasteful and creates an ink removal problem for the capping mechanism. Again the arrangements described in the above referenced US applications incorporate an ink collection and transport to sump function.

Outgassing is a significant problem for printheads having micron scale fluid flow conduits. Outgassing occurs when gasses dissolved in the ink (typically nitrogen) come out of solution to form bubbles. These bubbles can lodge in the ink line or even the ink ejection chambers and prevent the downstream nozzles from ejecting.

FIG. 10 shows the underside of the LCP moulding 65. Conduits 69 extend between the point where the printed IC (not shown) is mounted and the holes 69. Bubbles from outgassing 100 form in the upstream ink line and feed down to the printed IC.

FIG. 11 shows the artifacts that result from outgassing bubbles. As the bubbles 100 feed into the printhead IC, the nozzles deprime and start ejecting the bubble gas rather than ink. This appears as arrow head shaped artifacts 102 in the resulting print. Hopefully pressure from upstream ink flow eventually clears the bubble from the printhead IC and the artifacts disappear. However, the bubbles 100 can have a tendency to get stuck at conduit discontinuities. Discontinuities such as the silicon wall 78 across the channel 77 in the printhead IC (see FIG. 9) tend to trap some of the bubbles and effectively form an ink blockage to nozzles fed from that end of the channel 77. These usually result in streak type artifacts 104 extending from the bottom corners of the arrow head artifact 102. There is a significant risk that these bubbles do not eventually clear with continued printing which can result in persistent artifacts or nozzle burn out from lack of ink cooling.

Another problem that is difficult to address using component design is color mixing. Color mixing occurs when ink of one color establishes a fluid connection with ink of another color via the face of the nozzle plate. Ink from one ink loan can be driven into the ink loan of a different color by slightly different hydraulic pressures within each line, osmotic pressure differences and even simple diffusion.

Capping and wiping the nozzle plate will remove the vast majority of particulates that create the fluid flow path between nozzles. However, printhead IC's with high nozzle densities require only a single piece of paper dust or thin surface film to create significant color mixing while the printer is left idle for hours or overnight.

Instead of placing a heavy reliance on the design of the printhead assembly components to deal with factors that give rise to printhead maintenance issues, the present invention uses an active control system for the printhead maintenance regime to correct issues as they arise.

Figure 12B:
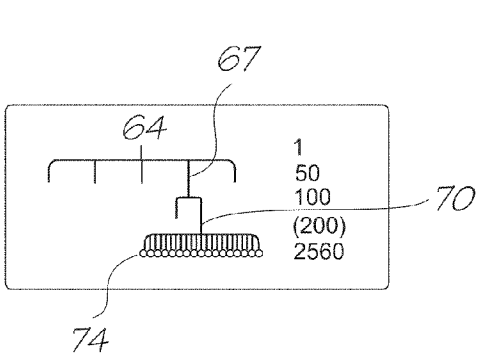
FIG. 12B is a sketch showing the ink line bifurcations in the prior art fluidic system.
Figure 12A:
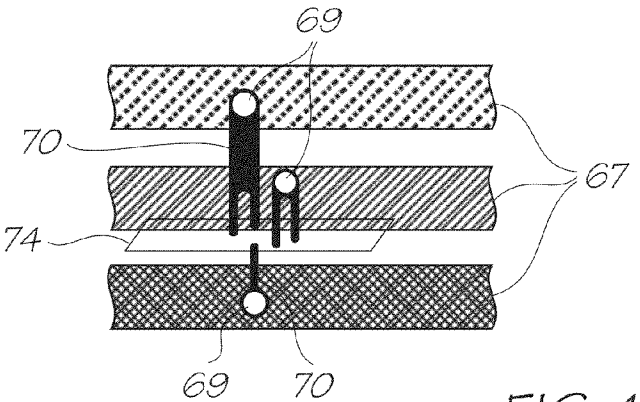
FIG. 12A is a sketch of the LCP moulding and the printhead IC in a fluidic system of the prior art.

FIGS. 12A and 12B are a schematic representation of the fluid architecture for the printhead shown in FIGS. 1 to 11. The different ink colors are fed to the channels 67 in an LCP moulding and fed through holes 69 to the smaller conduits 70 that lead to the printhead IC 74. As best seen in FIG. 12D, this architecture terminates the ink line at the printhead IC 74. Hence any attempts to change the ink flow conditions within the printhead IC 74 need to occur by intervention upstream.

Figure 13B:
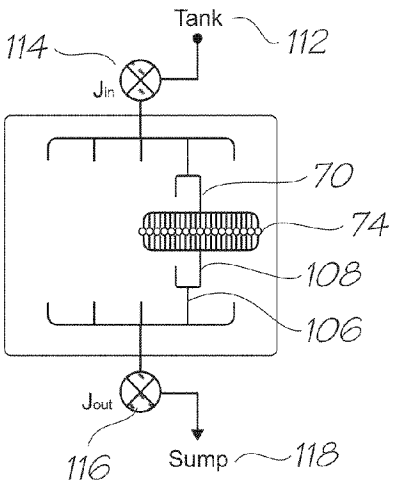
FIG. 13B is a sketch showing the ink line bifurcations in the fluidic system of the present invention.
Figure 13A:
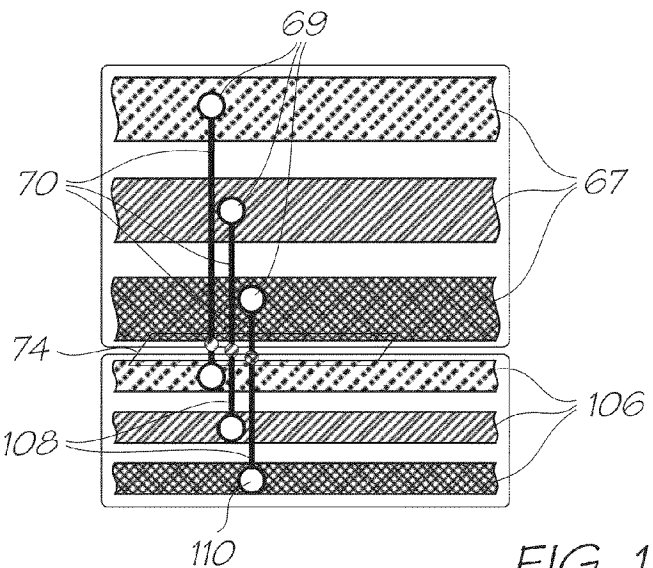
FIG. 13A is a sketch of the LCP moulding and the printhead IC in a fluidic system of the present invention.

FIGS. 13A and 13B sketch a fluid ink architecture in which the printhead IC 74 is not the end of the ink line. The small conduits 70 in the LCP moulding do not terminate at the holes feeding the printhead IC 74 but rather continue on to downstream channels 108 feeding holes 110 into downstream channels 106 in the LCP moulding. In this way bubbles in the ink line do not need to be purged out through the printhead IC 74. Instead the bubbles can completely bypass the printhead IC 74 in favor of the downstream ink conduits 108.

As shown in FIG. 13B the ink line upstream of the printhead IC 74 has a pump 114 as does the downstream ink line 116. This provides the control system with even greater flexibility for creating desired flow conditions within the ink line in general and the printhead IC 74 in particular.

The downstream pump 116 feeds to sump 118 and this highlights that the fluid architecture of the present system creates more waste ink than the architecture sketched in FIGS. 12A and 12B.

Figure 14:
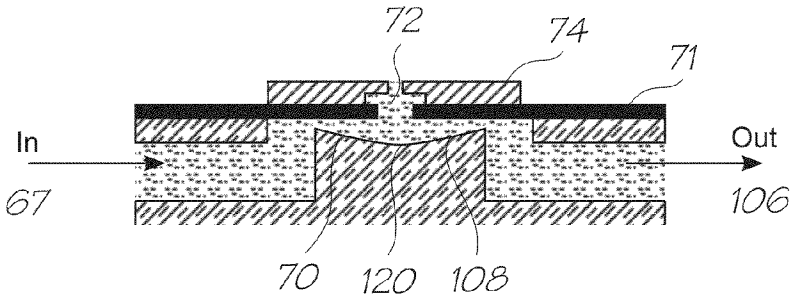
FIG. 14 is a schematic cross section of the LCP moulding and the printhead IC in a fluidic system of the present invention.

FIG. 14 is a schematic section view through the LCP moulding, the polymer sealing film 21 and the printhead IC 74. It illustrates the ink flow from the LCP channel 67 to the upstream conduit 70 past the inlet 72 (see FIG. 9) to the printhead IC 74 to the downstream ink conduit 108 but feeds the downstream LCP channel 106. It will be appreciated that the upstream conduit 17 and the downstream conduit 108 are essentially a single conduit 120.

Figure 15C:
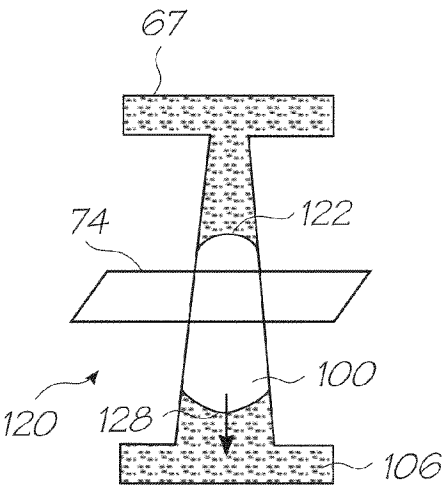
FIGS. 15A to 15C show the LCP conduit profiling for passive bubble control.
Figure 15B:
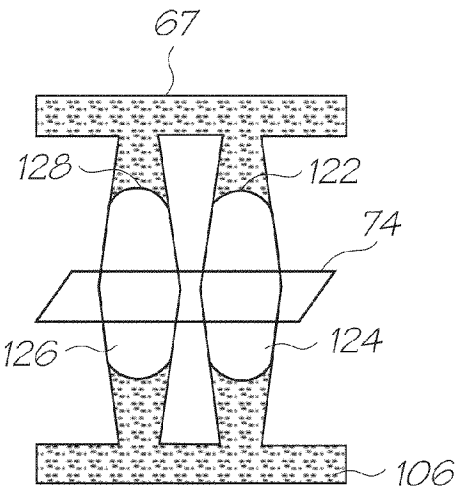
Figure 15A:
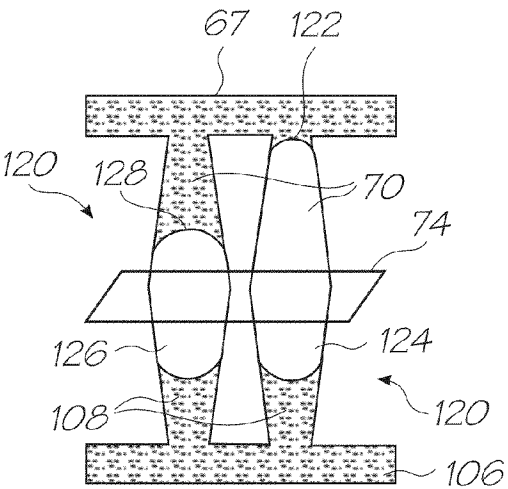

FIGS. 15A, 15B and 15C illustrate how the walls of the conduits 120 can be profiled to better control the position of any bubbles that inevitably contaminate the ink line. FIG. 15A shows two conduits 120 feeding ink between the upstream LCP channel 67 and the downstream LCP channel 106 both conduits have bubbles contaminating the ink flow. However, bubble 126 in the left hand conduit 120 is significantly smaller than the bubble 124 in the right hand conduit. By tapering the upstream conduit 70 from the printhead IC towards the upstream LCP channel 67 the bubble 124 is forced to have part of its surface with a higher radius of curvature 122. The smaller bubble 126 has a relatively large radius of curvature 128. The higher degree of curvature at 122 creates a stronger capillary force for drawing ink down the upstream end 70 of the right hand ink conduit 120.

As shown in FIG. 15B profiling the sides of the ink conduits 120 tend to make the bubble contaminants 126 and 124 become a uniform size such that the printhead IC 74 is primed and deprimed more uniformly.

As shown in FIG. 15C profiling the ink conduit 120 can be used to move ink bubbles 100 past the printhead IC 74 to minimise the amount of bubble contamination within the ejection nozzles and chambers. By tapering the sides of the ink conduit 120 from the downstream LCP channel 106 to the upstream LCP channel 67, the bubble 100 will tend to have a smaller radius of curvature 122 at its downstream end than its upstream end 128. Because of the surface tension and capillarity the bubble 100 is biased towards the downstream LCP channel 106 and so tends not to become lodged at the inlets to the printhead IC 74. The printhead IC 74 may draw in small amounts of the air bubble 100 but it is not forced to expel the entire bubble as with the architecture shown in FIGS. 12A and 12B.

Figure 16:
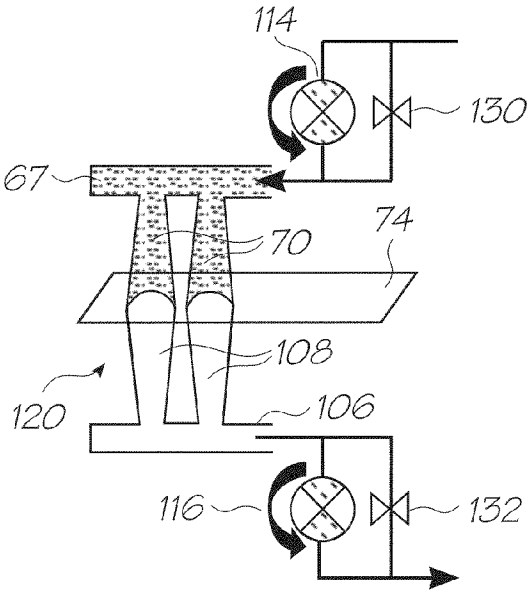

The versatility of the control system will now be illustrated with reference to FIGS. 16 to 21. As shown in FIG. 16, both of the upstream and downstream pumps 114 and 116 have a shutoff valve in a parallel bypass line (113 and 132 respectively). To prime the fluidic system with ink up to the back of the printhead IC 74 the controller sets both shutoff valves 113 and 132 to "close". The upstream pump 114 pushes ink through the upstream LCP channel 67 and down the upstream end of the conduits 120. The downstream pump 116 is driven at a slightly higher rate. Typically it operates at about 20% more capacity than the upstream pump 114. As the upstream pump has a lower capacity than the downstream pump the difference in the flow rate is made up by air drawn in through the printhead IC 74. This ensures that the fluidic architecture is primed with ink up to the back of the printhead IC 74 and all bubble contaminants removed from the upstream LCP channel 67 and upstream conduits 70.

Figure 17:
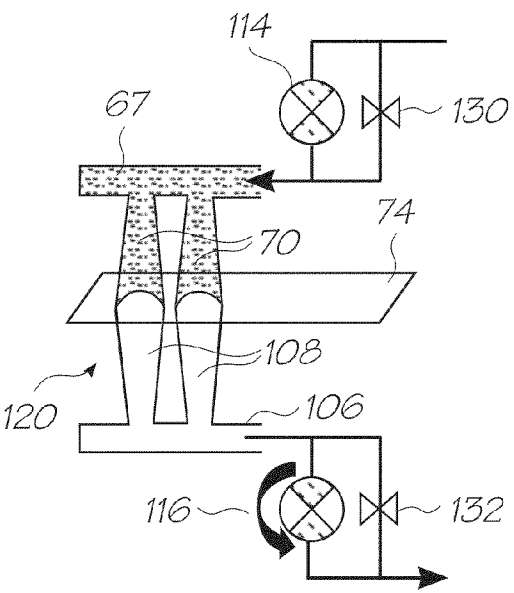

FIG. 17 shows the system configuration for depriming the architecture downstream with the printhead IC 74. Both the shut off valves 113 and 132 are closed while the upstream pump is deactivated. When either pump is deactivated, it essentially acts as a closed shutoff valve. This means that the upstream end of the ink line is choked of any ink supply. Meanwhile the downstream pump 116 slowly draws any ink out of the downstream ends 108 of the conduits 120 and the downstream LCP channel 106. Eventually the downstream pump 116 is simply drawing air through the printhead IC 74. This configuration ensures that the system has be deprimed downstream of the printhead IC 74.

Figure 18:
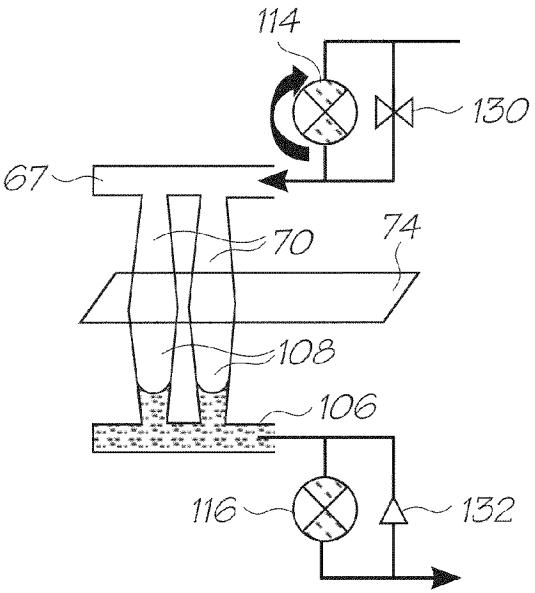
FIGS. 16 to 21 show the various unit operations that are possible with the active control provided by the present invention.

FIG. 18 shows the system configuration for depriming the fluid architecture upstream of the printhead IC 74. With this configuration the upstream shut off valve 130 is closed and the upstream pump is operating in reverse. Meanwhile the downstream shut off valve 132 is open and the downstream pump 116 is deactivated. The upstream pump 114 draws any ink through the upstream lines 70 and 67 back towards the cartridge (not shown). The open shut off valve 132 will allow some of the ink in the downstream end of the ink lines 106 and 108. However, eventually the upstream pump 114 draws air only through the upstream conduits 70 and 67 from the printhead IC 74.

Figure 19:
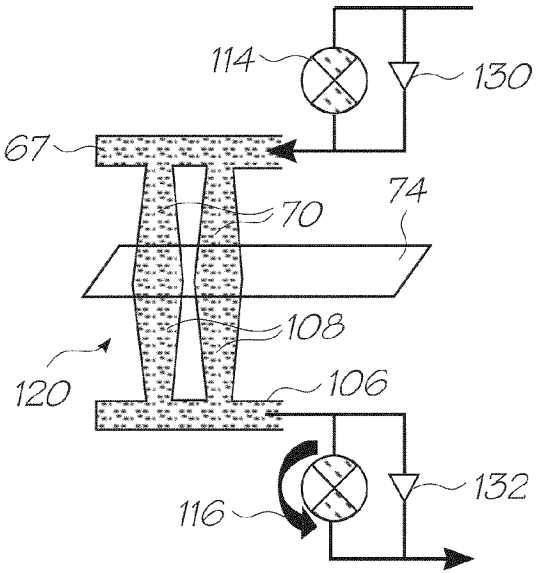

FIG. 19 shows the system configuration for creating a desired negative pressure that the printhead IC 74. The advantages of having a negative hydrostatic pressure at the nozzles of the printhead IC are discussed in details in the above referenced U.S. Ser. No. 11/014,769 filed Dec. 20, 2004. Both the upstream and downstream shut off valves 113 and 132 are open. However, the upstream pump 114 is deactivated and acts as a closed shut off valve. Downstream of the printhead IC 74 the downstream pump 116 is activated but operates relatively slowly. As the shut off valve 132 is open the downstream valve 116 creates a flow circulating from the pump through the downstream shut off valve 132 and the returning back through the pump 116. As the upstream shut off valve 130 is open a small amount of ink from the downstream conduits 108 and 106 are drawn into the circulating loop of ink by Venturi effects. For conservation of flow, a small amount of ink bleeds off to the sump.

As the Venturi effect from the circulating ink drops the hydrostatic pressure in the downstream conduits 108 and 106 the hydrostatic pressure at the printhead IC 74 also drops.

Figure 20:
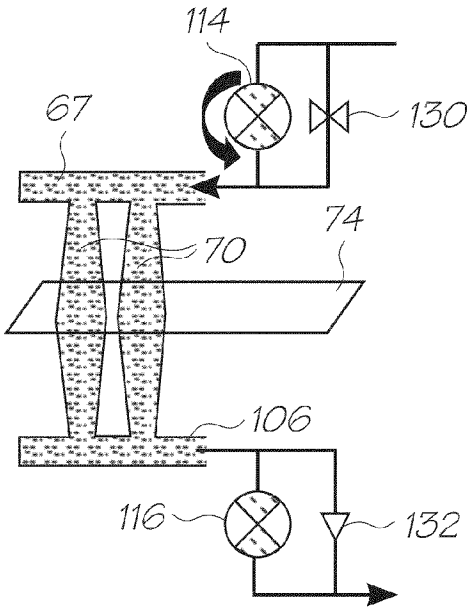

Referring to FIG. 20 the configuration for ink flow through or "purge" is shown. The upstream shut off valve 130 is closed however the upstream pump 114 is activated and supplying the upstream conduit 67 and 70 with ink. The downstream shut off valve 132 is open while the downstream pump 116 is deactivated and therefore closing that branch of the fluid system. This configuration draws ink directly from the supply and feeds it to the sump. This involves some degree of ink wastage however it purges the entire architecture of bubbles caused by outgassing.

Figure 21:
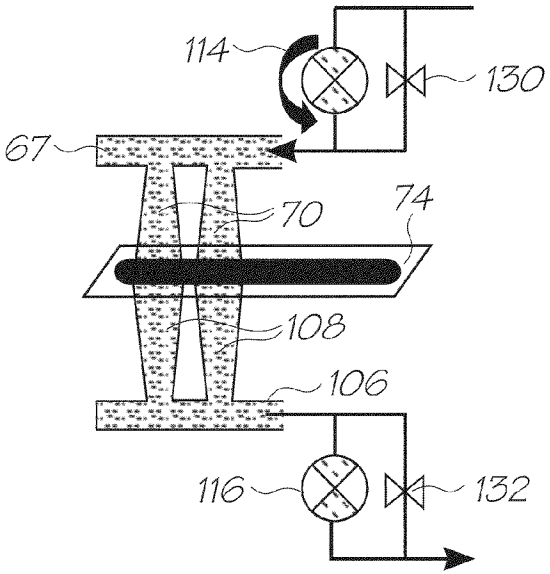

FIG. 21 shows the configuration needed to purge the printhead IC 74. In this configuration the downstream pump 116 and downstream shut off valve 132 are deactivated and closed. This essentially creates a flow obstruction downstream of the printhead IC 74. Upstream of the printhead IC the upstream pump 114 is activated but the upstream shut off valve 130 is closed. This forces ink out of the nozzles in the printhead IC until it beads and collects on the surface of the nozzle face. From there, the purged ink can be collected and transported to the sump using a mechanism such as those described in the above referenced co-pending applications filed in the US (U.S. Ser. No. 11/246,707, on Oct. 11, 2005.

The active control system in by the present fluidic architecture offers a versatile range of operations that allow the user to recover the printhead whenever artifacts are noticed. It also allows the manufacturer to ship the printhead IC's deprimed so that the user primes them on initial start up. For example after final print testing of the printhead assemblies are shipped dry. The control system is used to deprime upstream and then deprime downstream of the printhead IC 74.

During start up, the configuration shown in FIG. 16 is used to prime upstream then the configuration of FIG. 20 creates a flow through condition after which the configuration of FIG. 19 establishes a negative pressure at the printhead IC. During printing the configuration of FIG. 19 can maintain a desired negative pressure condition at the printhead nozzles.

To correct dry nozzles or osmotic color mixing the user can deprime downstream then prime upstream followed by establishing a negative pressure.

In order to address outgassing in the ink line, the user can perform a flow through purge as illustrated in FIG. 20.

In order to remove some external contamination of the printhead IC or ink contamination within the ink lines, the control system can flood the printhead as shown in FIG. 21 before re-establishing a negative pressure as shown in FIG. 19.

At the end of the print job, the control system can be set to automatically deprime downstream of the printhead IC before the capper places a perimeter seal around the printhead IC.

The upstream and downstream pumps 114 and 116 can be provided by peristaltic pumps. In the printers of the type shown in the above referenced U.S. Ser. No. 11/014,769 the peristaltic pumps have a displacement resolution of 10 microliters. This equates to about 5 mm of travel on an appropriately dimensional peristaltic tube. These specifications give the most flow rate of about 3 milliliters per minute and very low pulse in the resulting flow.

The valves should preferably be zero displacement, zero leak, fast and easy to actuate. Ordinary workers in this field will readily identify a range of valve mechanisms that satisfy these requirements.

Single Pump Implementations

Figure 22:
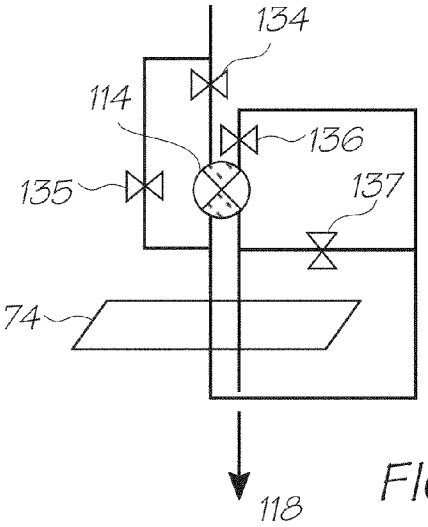
FIG. 22 shows a single pump/four valve implementation of the fluidic system.

FIG. 22 shows a first single pump implementation of the fluidic control system. This implementation uses four shut off valves 134, 135, 136 and 137 in order to direct ink flows past the printhead IC 74 and eventually to the sump 118. Set out in Table 1 below are the operational statuses for each of the valves and the pump in order to provide the various control states within the architecture. In relation to the pump status column "down" is an indication that the peristaltic pump 114 is driving ink flow downwards as shown in FIG. 22 and "up" indicates ink flow upwards as it appears in FIG. 22.

TABLE 1

Single Pump/Four Valve Implementation

| Flow Condition | Pump 114 | Valve 134 | Valve 135 | Valve 136 | Valve 137 |
|---|---|---|---|---|---|
| prime | down | open | Closed | closed | open |
| print | up | open | Open | closed | closed |
| flush | down | open | Closed | closed | open |
| flood | down | open | Closed | closed | closed |
| deprime downstream | down | closed | Closed | open | closed |
| deprime upstream | up | open | Closed | closed | closed |
| standby | deactivated | closed | Closed | closed | Closed |

Figure 23:
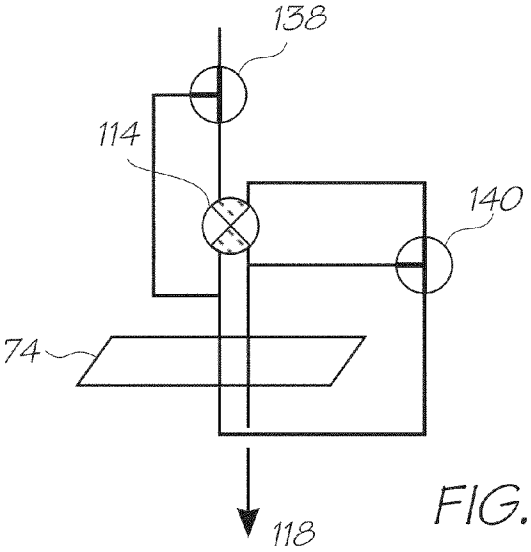
FIG. 23 shows a single pump/two valve implementation of the fluidic system.

FIG. 23 shows a second single pump implementation that uses only two valves to achieve all the control states possible in the above described implementations. However in this implementation, the valves 138 and 140 are 3-way valves and therefore slightly more expensive components.

Table 2 below sets out the operational status for each of the system components in order to achieve the flow conditions achieved by the two pump implementation.

TABLE 2

Single Pump to Valve Implementation

| Function | Pump 114 | Valve 138 | Valve 140 |
|---|---|---|---|
| Prime | Down | Inline | Inline |
| Print | Up | Inline | Recirculate |
| Flush | Down | Inline | Bypass |
| Flood | Down | Inline | Recirculate |
| Deprime Downstream | Down | Recirculate | Inline |
| Deprime upstream | Up | Inline | Recirculate |
| Standby | Up | Recirculate | Recirculate |

Figure 24:
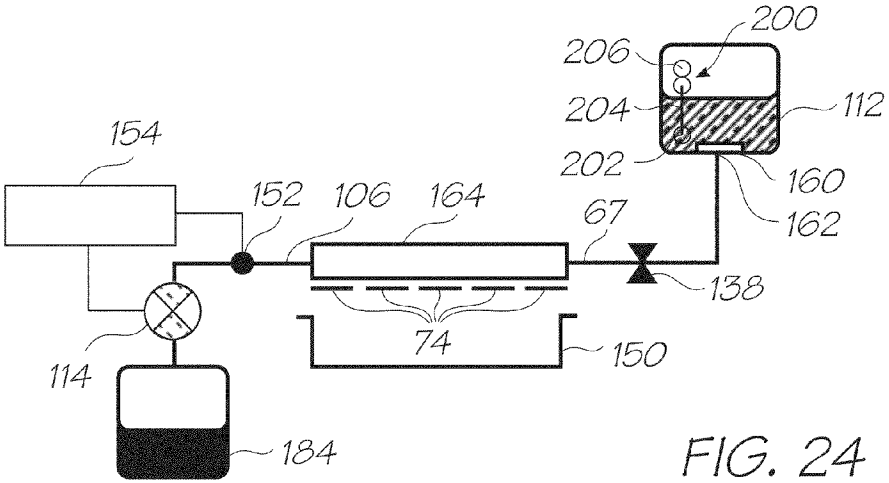
FIG. 24 is a sketch of another single pump fluidic system.

FIG. 24 shows a third single pump implementation that further simplifies the fluidic architecture. It will be appreciated that only a single ink line is shown and a color printer would have separate lines (and of course separate ink tanks 112) for each ink color. As shown in FIG. 24, this architecture has a single pump 114 downstream of the LCP moulding 164, and a shut off valve 138 upstream of the LCP moulding. The LCP moulding supports the printhead IC's 74 via the adhesive polymer film 71 (see FIG. 2). The shut off valve 138 isolates the ink in the ink tank 112 from the printhead IC's 74 whenever the printer is powered down. This prevents any color mixing at the printhead IC's 74 from reaching the ink tank 112 during periods of inactivity. These issues are discussed in more detail below with reference to the shut off valve shown in FIGS. 29 and 30.

The ink tank 112 has a venting bubble point pressure regulator 200 for maintaining a relatively constant negative hydrostatic pressure in the ink at the nozzles. Bubble point pressure regulators within ink reservoirs are comprehensively described in co-pending application Ser. No. 11/640,355 filed 18 Dec. 2006 incorporated herein by reference. However, for the purposes of this description the regulator 202 is shown as a bubble outlet 204 submerged in the ink of the tank 112 and vented to atmosphere via sealed conduit 204 extending to an air inlet 206. As the printhead IC's 74 consume ink, the pressure in the tank 112 drops until the pressure difference at the bubble outlet 202 sucks air into the tank. This air forms a forms a bubble in the ink which rises to the tank's headspace. This pressure difference is the bubble point pressure and will depend on the diameter (or smallest dimension) of the bubble outlet 202 and the Laplace pressure of the ink meniscus at the outlet which is resisting the ingress of the air.

The bubble point regulator uses the bubble point pressure needed to generate a bubble at the submerged bubble outlet 202 to keep the hydrostatic pressure at the outlet substantially constant (there are slight fluctuations when the bulging meniscus of air forms a bubble and rises to the headspace in the ink tank). If the hydrostatic pressure at the outlet is at the bubble point, then the hydrostatic pressure profile in the ink tank is also known regardless of how much ink has been consumed from the tank. The pressure at the surface of the ink in the tank will decrease towards the bubble point pressure as the ink level drops to the outlet. Of course, once the outlet 202 is exposed, the head space vents to atmosphere and negative pressure is lost. The ink tank should be refilled, or replaced (if it is a cartridge) before the ink level reaches the bubble outlet 202.

The ink tank 112 can be a fixed reservoir that can be refilled, a replaceable cartridge or (as disclosed in U.S. Ser. No. 11/014,769 US incorporated by reference) a refillable cartridge. To guard against particulate fouling, the outlet 162 of the ink tank 112 has a filter 160. As the system also contemplates limited reverse flow, some printers may incorporate a filter downstream of the printhead IC 74 as well. However, as filters have a finite life, replacing old filters by simply replacing the ink cartridge is particularly convenient for the user. If the upstream and or downstream filters are a separate consumable item, regular replacement relies on the user's diligence.

When the bubble outlet 202 is at the bubble point pressure, and the shut off valve 138 is open, the hydrostatic pressure at the nozzles is also constant and less than atmospheric. However, if the shut off valve 138 has been closed for a period of time, outgassing bubbles may form in the LCP moulding 164 or the printhead IC's 74 that change the pressure at the nozzles. Likewise, expansion and contraction of the bubbles from diurnal temperature variations can change the pressure in the ink line 67 downstream of the shut off valve 138. Similarly, the pressure in the ink tank can vary during periods of inactivity because of dissolved gases coming out of solution.

The downstream ink line 106 leading from the LCP 164 to the pump 114 can include an ink sensor 152 linked to an electronic controller 154 for the pump. The sensor 152 senses the presence or absence of ink in the downstream ink line 106. Alternatively, the system can dispense with the sensor 152, and the pump 114 can be configured so that it runs for an appropriate period of time for each of the various operations. This may adversely affect the operating costs because of increased ink wastage.

The pump 114 feeds into a sump 184 (when pumping in the forward direction). The sump 184 is physically positioned in the printer so that it is less elevated than the printhead ICs 74. This allows the column of ink in the downstream ink line 106 to 'hang' from the LCP 164 during standby periods, thereby creating a negative hydrostatic pressure at the printhead ICs 74. A negative pressure at the nozzles draws the ink meniscus inwards and inhibits color mixing. Of course, the peristaltic pump 114 needs to be stopped in an open condition so that there is fluid communication between the LCP 164 and the ink outlet in the sump 184.

As discussed above, pressure differences between the ink lines of different colors can occur during periods of inactivity. Furthermore, paper dust or other particulates on the nozzle plate can wick ink from one nozzle to another. Driven by the slight pressure differences between each ink line, color mixing can occur while the printer is inactive. The shut off valve 138 isolates the ink tank 112 from the nozzle of the printhead IC's 74 to prevent color mixing extending up to the ink tank 112. Once the ink in the tank has been contaminated with a different color, it is irretrievable and has to be replaced. This is discussed further below in relation to the shut off valve's ability to maintain the integrity of its seal when the pressure difference between the upstream and downstream sides of the valve is very small.

The capper 150 is a printhead maintenance station that seals the nozzles during standby periods to avoid dehydration of the printhead ICs 74 as well as shield the nozzle plate from paper dust and other particulates. The capper 150 is also configured to wipe the nozzle plate to remove dried ink and other contaminants. Dehydration of the printhead ICs 74 occurs when the ink solvent, typically water, evaporates and increases the viscosity of the ink. If the ink viscosity is too high, the ink ejection actuators fail to eject ink drops. Should the capper seal be compromised, dehydrated nozzles can be a problem when reactivating the printer after a power down or standby period.

The problems outlined above are not uncommon during the operative life of a printer and can be effectively corrected with the relatively simple fluidic architecture shown in FIG. 24. It also allows the user to initially prime the printer, deprime the printer prior to moving it, or restore the printer to a known print ready state using simple trouble-shooting protocols. Several examples of these situations are set out below.

Initial Priming

Figure 25A:
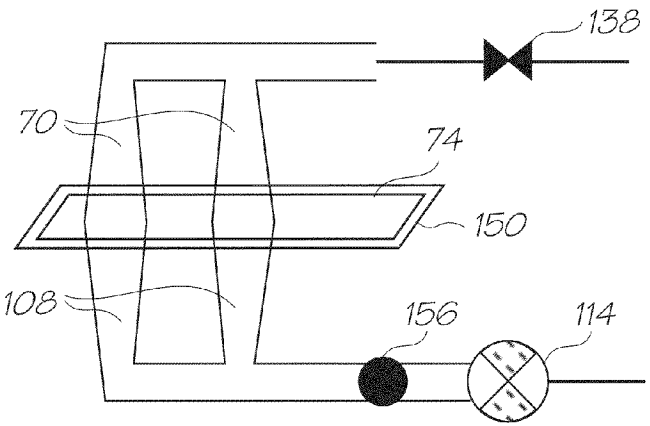
FIGS. 25A and 25B schematically show the fluidic system FIG. 24 and the initial priming of the printhead IC.
Figure 25B:
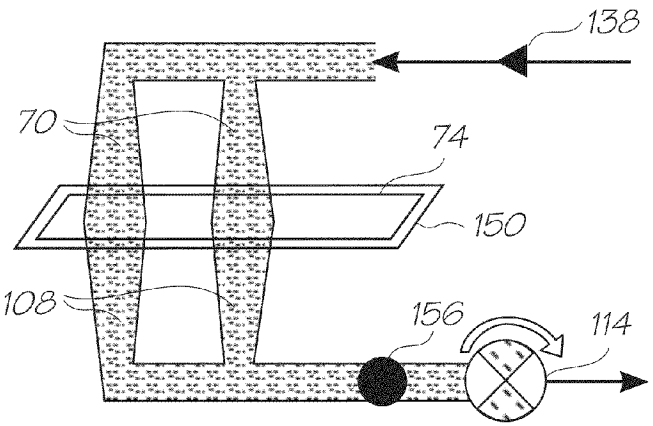

The printheads (or fully assembled printers) are shipped deprimed of ink. Priming a new dry printhead upon installation is shown in FIGS. 25A and 25B. The capper 150 is applied to the printhead ICs 74 and the shut off valve 138 is initially closed. As shown in FIG. 25A, there is no ink in the upstream LCP channels 70 or the downstream LCP channels 108. An ink sensor 156 at the peristaltic pump 114 registers the absence of ink to the controller 154.

Referring to FIG. 25B, the shut off valve 138 is opened and the pump 114 pumps forward (from ink tank 112 to sump 184) Ink is infused into the upstream and downstream channels 70 and 108 of the LCP moulding. Ink feeds into the printhead ICs 74 by capillary action. The multi-channel pump 114 (one channel per color) stops when the sensor 156 for all the ink lines register the presence of ink. The nozzles may be fired into the capper 150 to drop the pressure at the bubble outlet 202 to the bubble point pressure. On the other hand, simply printing the print job soon draws the pressure in the ink tank 112 down to the normal operating pressure.

Color Mixing

If the nozzle plate remains clean, there is no capillary bridging between the different ink lines. In most cases the capper 150 will effectively clean the nozzle plate, but in the event that paper dust wicks ink between nozzles, the shut off valve 138 protects the ink tank 112 from contamination. Mixing downstream of the shut off valve 138 can be easily rectified during the 'Standby-to-Ready' procedure described below.

Other techniques for guarding against color mixing include dehydrating the nozzles, leaving the pump 114 in an open condition and sparse keep wet dots. Keep wet dots are normally used to stop nozzles from drying out if the period between successive firings of a nozzle exceeds the decap time. Decap occurs when evaporation from the nozzle increases ink viscosity to the point that it can not longer eject. However, sparse and infrequent keep wet dots fired during standby will purge the nozzles of any contaminated ink before it can migrate too far along the upstream line.

Deliberately dehydrating the printhead ICs 74 prior to standby increases the ink viscosity and so inhibits its ability to wick across the nozzle plate. Simply warming the ink will dehydrate it and this can be achieved with sub-ejection pulses to the printhead ICs 74.

As discussed above, leaving the peristaltic pump 114 in the open position keeps the nozzles is in fluid communication with the waste ink outlet at the sump 184. The weight of ink in the downstream ink line 106 generates a negative pressure at the nozzles. A negative pressure at the nozzles creates a concave meniscus that is less prone to wick out onto the nozzle plate.

Standby to Ready

Figure 26A:
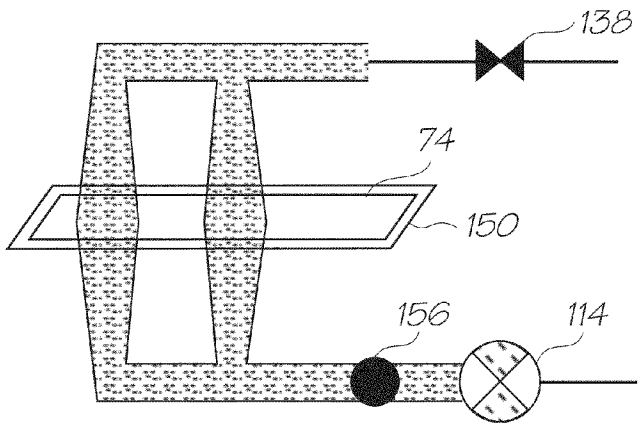
FIGS. 26A to 26E schematically show the operational stages of the fluidic system FIG. 24 moving from standby to print ready mode.
Figure 26B:
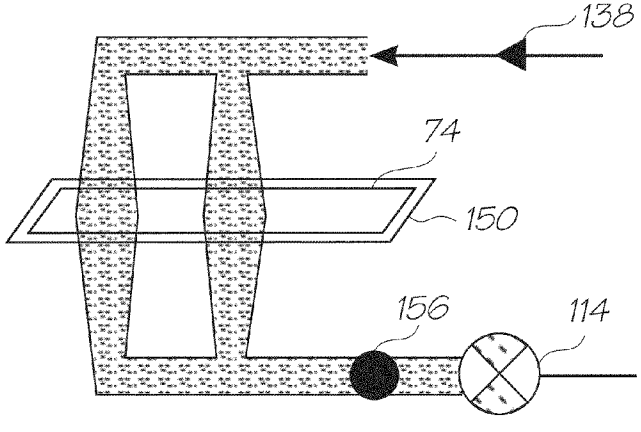

FIG. 26A shows the printer in standby. The shut off valve 138 is closed and the pump 114 is open. The capper 150 is sealed over the printhead ICs 74. If the printer has been in standby for a relatively short time (say, overnight), the ink will have dehydrated to a degree, but probably not to the point where the nozzles have dried out. However, even mild dehydration can visibly concentrate the ink and there may also be some color mixing. FIG. 26B shows the system configuration for purging the ink upstream of the printhead ICs. The shut off valve 138 is opened and the pump 114 is moved to a closed position (no fluid communication between the printhead ICs 74 and the sump 184). Then the printhead ICs 74 need to print a burst of dots with the capper 150 remaining in place to blot the purged ink. The volume of ink to be purged will depend on the printer, but as an indication the printhead shown in FIGS. 1 and 2 needs to print the equivalent of about 10% to 30% of a page in process black.

Figure 26D:
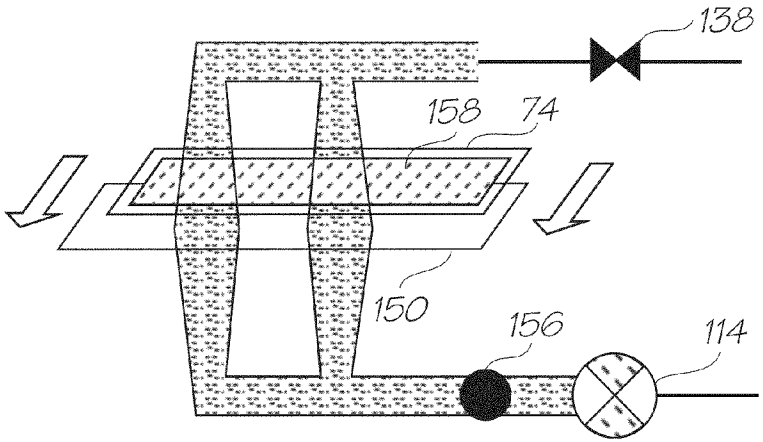
Figure 26C:
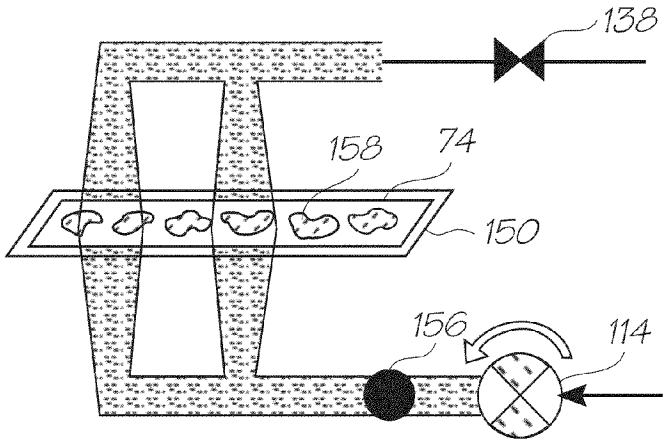

If the printer has been in standby for a longer period, the printhead may be primed by dehydrated through to the LCP moulding supporting the printhead ICs 74. In this case, the printhead ICs need to be primed with ejectable ink. FIG. 26C shows the process for achieving this. With the shut off valve 138 closed, the pump 114 is driven in reverse a small amount to force an ink flood 158 onto the nozzle plate of each IC 74. As shown in FIG. 26D, the capper 150 wipes the printhead ICs 74 to distribute the flood 158 across the nozzle plate, while firing the nozzles to prevent any ink migrating back into the LCP moulding. If this is not immediately successful, the process can be repeated until all the nozzles rehydrate.

When the printhead ICs 74 have rehydrated, the shut off valve 138 is opened (see FIG. 26E) and the pump 114 drives forward again and stops at the open position. The nozzles in the printhead ICs 74 are fired one last time to ensure there is no color mixing from wiping the ink flood across the nozzle plate.

Power Down/Move Printer

Figure 27A:
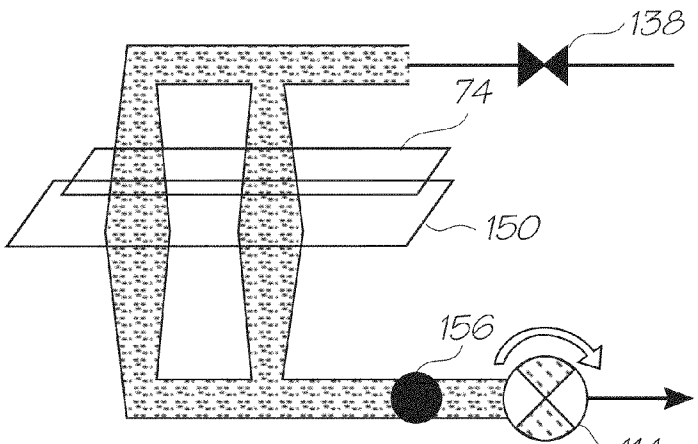
FIGS. 27A and 27B schematically show the fluidic system FIG. 24 moving to a long term power down mode/move printer mode.
Figure 26E:
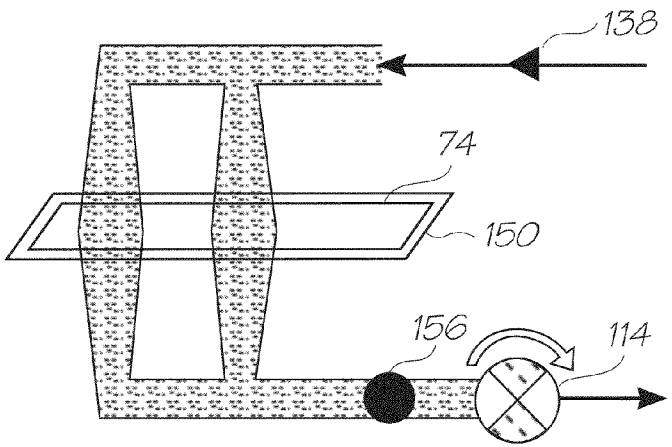
Figure 27B:
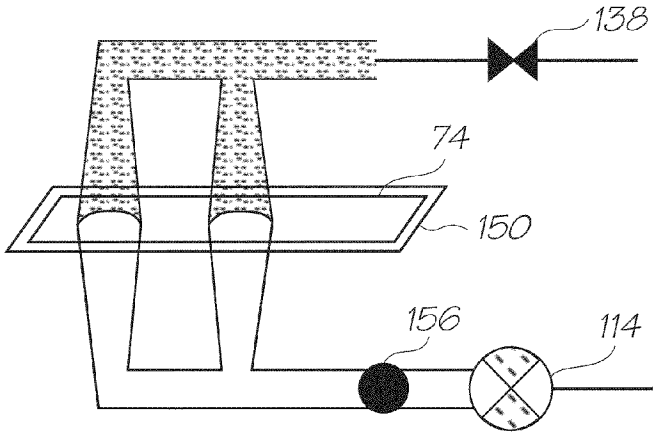

FIGS. 27A and 27B show the procedure for a controlled power down (i.e. the user switching off the main power switch). This would be used when the user is moving the printer, placing it in storage or similar. To avoid color mixing and flooding (because of jarring while being shifted) the printhead ICs 74 are deprimed. As shown in FIG. 27A, the shut off valve 138 is closed, while the capper 150 unseals the printhead ICs 74 and the pump 114 pumps forward to the sump.

Referring to FIG. 27B, air drawn through the nozzles deprimes the printhead ICs 74 and the downstream ink line to the pump 114. When the sensor 156 registers a lack of ink, the pump 114 stops at the closed position and the capper 150 seals the printhead ICs.

Power Failure

In the event of sudden failure of the power supply, the shut off valve 138 is biased to close. This prevents any color mixing in the ink tank. The pump 114 may be open or closed and the capper 150 may be sealed or unsealed depending on the printer status at the time of power failure. However, as long as the shut off valve closes to protect the ink tank, all other conditions can be rectified by the user when the power is restored.

Power Up

Figure 28A:
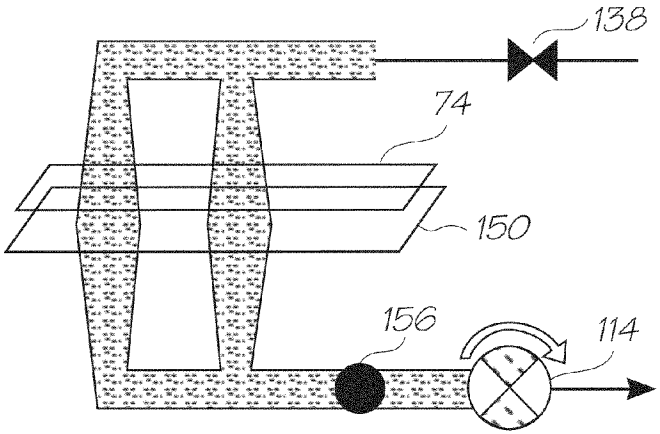
FIGS. 28A and 28C schematically show the fluidic system FIG. 24 recovering from long term power down/deprime/gross color mixing.
Figure 28C:
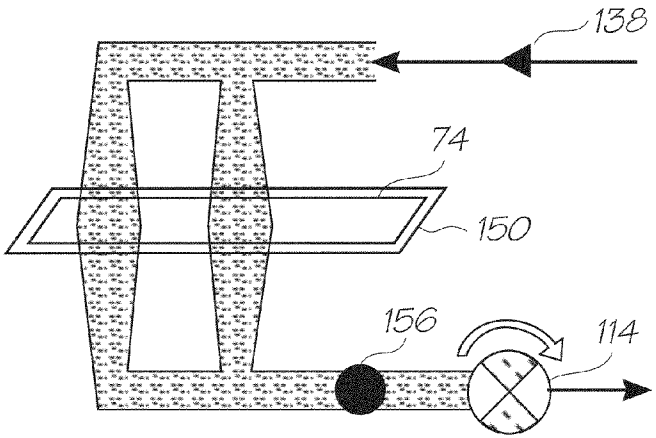
Figure 28B:
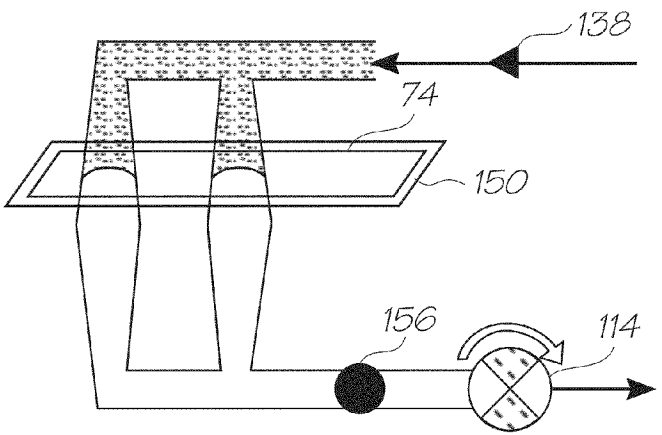

FIGS. 28A to 28C show the process for switching the printer on after a power down period. As the extent of deprime or color mixing is not known, the worst case is assumed—thoroughly mixed ink downstream of the shut off valve 138 to the pump 114. Referring to FIG. 28A this is fixed by deprimming the printhead ICs 74 and the downstream line to the pump 114. The shut off valve 138 remains closed while the capper 150 unseals the nozzles and the pump 114 pumps the ink forward to the sump. When the sensor 156 reads a lack of ink, the capper 150 reseals the printhead ICs 74 and the shut off valve 138 opens as shown in FIG. 28B. As shown in FIG. 28C, the ink upstream of the printhead ICs 74 is flushed through to the pump 114. When the sensor 156 registers the presence of ink, the shut off valve closed, and the pump 114 can be stopped, preferably in the open condition so that the hydrostatic pressure at the nozzles is less than atmospheric. The printer is now in Standby and to print, it simply initiates the Standby to Ready procedure discussed above.

Deprime Recovery

In the unlikely event that one of the printhead ICs deprimes during operation, the user can quickly address the problem by sealing the nozzles with the capper, opening the shut off valve 138 and pumping forward (as shown in FIG. 28 B). The LCP moulding refills with ink which infuses to the printhead ICs.

Flood Recovery

Should the printer get bumped or jarred, there is potential for the printhead ICs to flood ink onto the nozzle plate. The user corrects this by initiating the process set out if FIGS. 26C to 26E described above.

Gross Color Mixing

If the printed image reveals gross color mixing (cross contamination of the colors downstream of the shut off valve) the user should immediately follow the Power Up procedure shown in FIGS. 28A to 28C. The printhead IC deprime and subsequent reprime recovers the printer from most failure states (albeit not in the most ink economical way) and so may be the most frequently used remedy by the user.

Shut Off Valve

As discussed above, it is imperative that the ink tank is protected from color mixing. Once the ink in the supply tank is contaminated, it is irretrievable and must be replaced. To achieve this, the shut off valve 138 (see FIG. 24) should only be open when feeding ink to the printhead ICs 74 or flushing color mixed ink from the LCP moulding 164. At other times, the ink tank 112 should be kept fluidically isolated.

In light of this, the shut off valve 138 needs to be biased closed. Any power down should stop any fluid communication between the ink tank and the printhead ICs 74. It is important that the fluid seal in the valve be reliable as a small compromise to the seal will allow contaminants to migrate to the ink tank during long periods of printer inactivity. This is difficult when the pressure difference across the valve is very small as is the case in the upstream ink line. A large pressure difference tends to clamp the movable valve member against the valve seat, thereby assisting the integrity of the seal.

Figure 29:
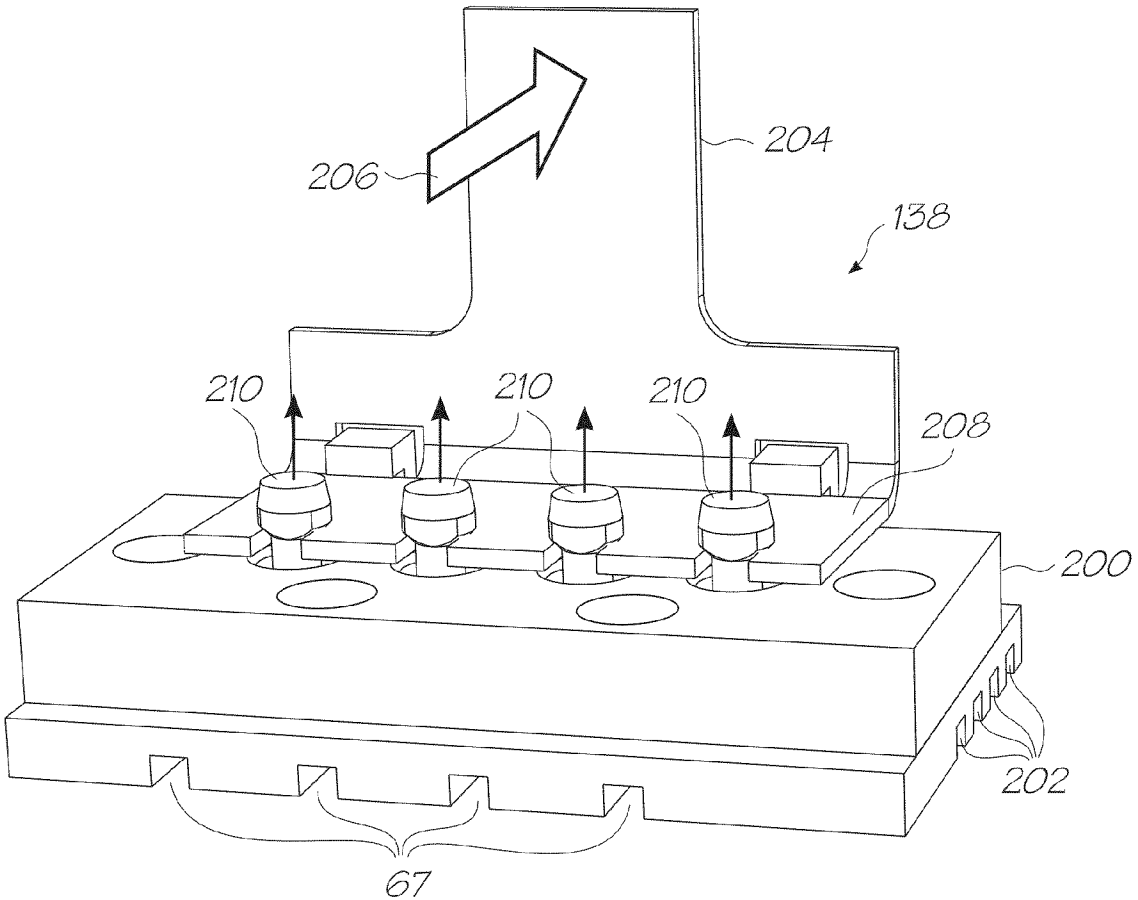
FIG. 29 is a perspective view of a shut off valve.
Figure 30:
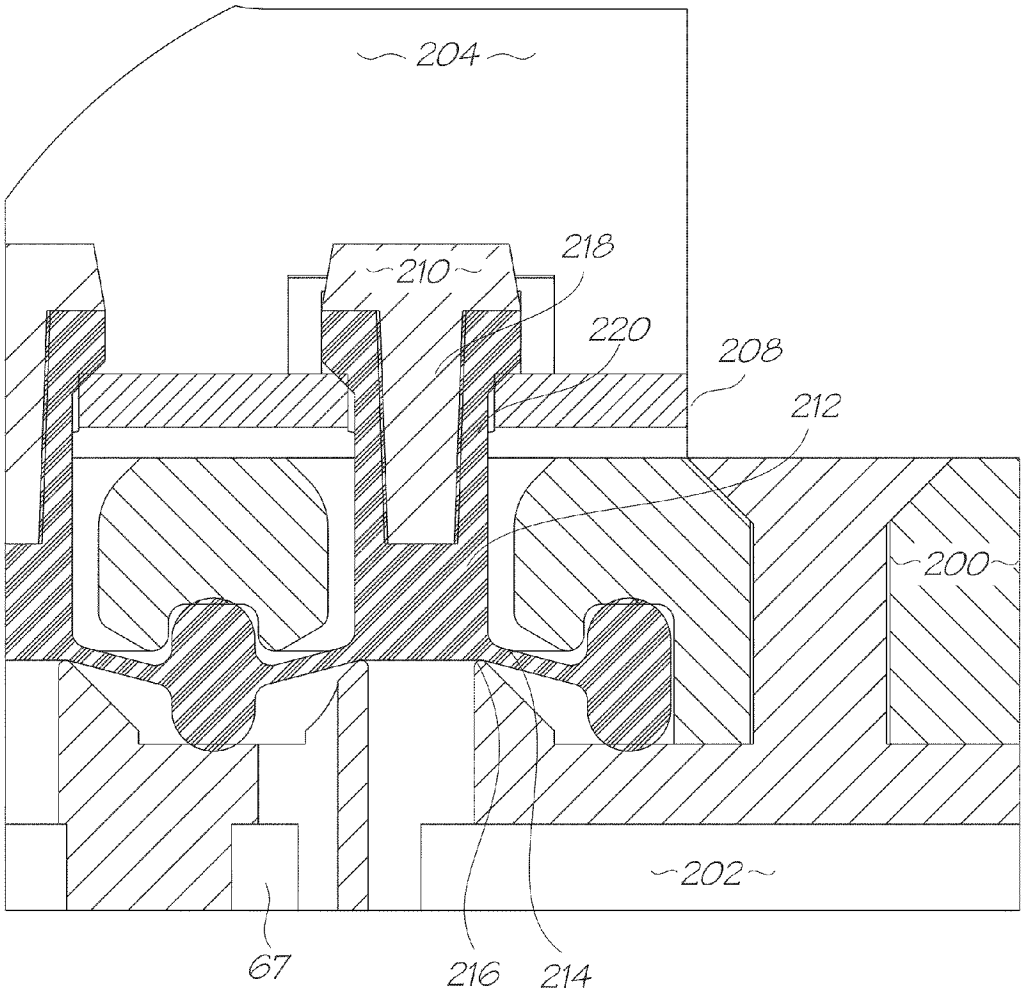
FIG. 30 is a partial section view of the shut off valve.

The valve 138 shown in FIGS. 29 and 30 opens and shuts the upstream ink line for each color simultaneously. The valve body 200 defines inlet channels 202 leading from the ink tank (not shown). Outlet channels 67 lead to the LCP moulding (not shown). An actuator arm 204 is pivoted to the valve body so that a multi valve lifter 208 raises the valve stems 210 when an actuation force 206 is applied.

FIG. 30 is a partial section view showing a single valve. The valve member 212 seals against the valve seat 216 under the biasing action of the diaphragm 214. The actuation force 206 works against the diaphragm bias to lift the valve stem 210 and unseat the valve member 214. However, the actuator arm 204 is a first class lever so the actuator force 206 uses a mechanical advantage to lift the stems 210.

As discussed above, the pressure difference across the valve is small but the integrity of the seal against the valve seat 216 is maintained by the elastically deformed diaphragm 214. The valve body 212 is a resilient material such as polyurethane for fluid tight sealing against the valve seat 216. However, the valve stem 210 has a flanged metal pin 218 fitted into an axial recess 220. This ensures the valve lifter 208 does not simply slip off the end of the stem 210 by compressing the (relatively) soft resilient material of the valve member 212.

The diaphragm 214 has another important advantage in that it increases the interior volume of the ink line when the valve opens. The relatively large surface area of the diaphragm 214 creates suction in the ink line as it lifts up to unseat the valve member 216. As discussed above, creating some suction in the upstream ink line will assist the ink tank to drop to the pressure where the bubble point regulator (see FIG. 24) controls the negative pressure at the printhead ICs.

While lifting the diaphragm drops the hydrostatic pressure in the ink line, lowering the diaphragm too quickly when the valve closes can create a pressure spike. This is undesirable as it can cause flooding on the nozzle plate of the printhead ICs, particularly if the peristaltic pump is in the closed condition. However, closing the valve slowly avoids sending a pulse through the ink line. The reduction in the internal volume caused by lowering the diaphragm is absorbed by raising the level in the ink tank. In view of this, the actuator should open the valve faster than it closes the valve. A solenoid with damped return stroke may be used. Another simple actuator uses a shape memory alloy. A shape memory alloy, such as Nitinol™ wire, tends to inherently damp its return stroke. A heating current drive the initial martensitic to austenitic phase change, but it reverts to martensite by conductive cooling which tends to be slower. This slow phase change can be used avoid pressure pulses at the printhead ICs.

The invention has been described herein by way of example only. Skilled workers in this field will readily recognize many variations and modifications which do not depart from the spirit and scope of the broad inventive concept.

We claim:

1. A printhead assembly for an inkjet printer, the printhead assembly comprising:

a printhead with an array of nozzles for ejecting ink onto print media;

a shut off valve with an ink inlet for connection to an ink supply, an ink outlet for connection to the printhead, a valve seat and a diaphragm biased into sealing engagement with the valve seat to seal the printhead from the ink supply; and, an actuator for unsealing the diaphragm from the valve seat when energized; wherein, the ink outlet and the ink inlet are both in fluid communication with one side of the diaphragm, such that unsealing the diaphragm draws the diaphragm away from the valve seat to lower the fluid pressure in the ink inlet and the ink outlet.

2. A printhead assembly according to claim 1 wherein the printhead has a printhead IC in which the array of nozzles is formed.

3. A printhead assembly according to claim 1 wherein the bias urging the diaphragm into sealing engagement with the valve seat is residual tension in the diaphragm.

4. A printhead assembly according to claim 1 wherein the actuator works against the bias of the diaphragm to unseal the valve seat.

5. A printhead assembly according to claim 1 wherein the actuator has a solenoid.

6. A printhead assembly according to claim 1 wherein the actuator has a shape memory alloy.

7. A printhead assembly according to claim 6 wherein the shape memory alloy comprises a Nitinol™ wire.

8. A printhead assembly according to claim 1 wherein the diaphragm is polyurethane.

9. A printhead assembly according to claim 1 wherein the actuator draws the diaphragm away from the valve seat more quickly than the diaphragm reseals the valve member to the valve seat.

10. A printhead assembly according to claim 1 wherein the valve seat has a frusto-conical surface for sealing against a complementary surface extending from one side of the diaphragm.

* * * * *